US006418581B1

(12) United States Patent
Bruce et al.

(10) Patent No.: US 6,418,581 B1
(45) Date of Patent: Jul. 16, 2002

(54) CONTROL SYSTEM FOR MEASURING LOAD IMBALANCE AND OPTIMIZING SPIN SPEED IN A LAUNDRY WASHING MACHINE

(75) Inventors: Mats Gunnar Bruce, Panama City; Christopher Andrew Oswald; Albert Ford Adcock, both of Lynn Haven, all of FL (US)

(73) Assignee: Ipso-USA, Inc., Panama City, FL (US)

( * ) Notice: Subject to any disclaimer, the term of this patent is extended or adjusted under 35 U.S.C. 154(b) by 0 days.

(21) Appl. No.: 09/344,170

(22) Filed: Jun. 24, 1999

(51) Int. Cl.[7] ..... D06F 33/02

(52) U.S. Cl. ..... 8/159; 68/12.06; 68/12.02; 68/12.16

(58) Field of Search ..... 68/12.02, 13 R, 68/12.06, 12.16; 8/158, 159; 318/807, 808, 809

(56) References Cited

U.S. PATENT DOCUMENTS

| | | | | |
|---|---|---|---|---|
| 3,931,553 | A | | 1/1976 | Stich et al. |
| 3,947,740 | A | | 3/1976 | Tsuboi |
| 4,235,085 | A | | 11/1980 | Torita |
| 4,250,435 | A | | 2/1981 | Alley et al. |
| 4,303,406 | A | | 12/1981 | Ross |
| 4,329,630 | A | | 5/1982 | Park |
| 4,400,838 | A | | 8/1983 | Steers et al. |
| 4,503,575 | A | | 3/1985 | Knoop et al. |
| 4,607,408 | A | | 8/1986 | Didier et al. |
| 4,697,293 | A | | 10/1987 | Knoop |
| 4,779,430 | A | | 10/1988 | Thuruta et al. |
| 4,800,326 | A | * | 1/1989 | Unsworth |
| 4,857,814 | A | | 8/1989 | Duncan |
| 4,862,710 | A | | 9/1989 | Torita et al. |
| 4,916,370 | A | | 4/1990 | Rowan et al. |
| 5,161,393 | A | | 11/1992 | Payne et al. |
| 5,301,523 | A | | 4/1994 | Payne et al. |
| 5,507,054 | A | * | 4/1996 | Blauert et al. |
| 5,627,447 | A | | 5/1997 | Unsworth et al. |
| 5,970,555 | A | * | 10/1999 | Baek et al. |
| 6,029,300 | A | * | 2/2000 | Kawaguchi et al. |
| 6,038,724 | A | * | 3/2000 | Chbat et al. |

FOREIGN PATENT DOCUMENTS

| | | |
|---|---|---|
| DE | 198 12 682 A1 | 9/1998 |
| EP | 539 617 A1 | 5/1993 |
| EP | 539 617 A1 | 5/1993 |
| EP | 879 913 A1 | 11/1998 |
| JP | 10 263261 A | 10/1998 |
| JP | 10 305189 | 11/1998 |

* cited by examiner

*Primary Examiner*—Frankie L. Stinson
(74) *Attorney, Agent, or Firm*—Adams, Schwartz & Evans, P.A.

(57) ABSTRACT

A control system for measuring load imbalance in a laundry washing machine having a non-vertical axis of drum rotation, and then using the value obtained for the load imbalance to calculate a maximum permissible angular velocity for the drum during the water extraction cycle.

9 Claims, 21 Drawing Sheets

CONTROL SYSTEM FOR MEASURING LOAD IMBALANCE AND OPTIMIZING SPIN SPEED IN A LAUNDRY WASHING MACHINE

BACKGROUND

1. Field of Invention

This invention relates to the field of laundry washing machines. More specifically, the invention comprises a method and apparatus for measuring load imbalance in the spinning drum of a washing machine, and then using the value of the load imbalance to calculate the maximum safe spinning speed during the water extraction cycle.

BACKGROUND

2. Description of Prior Art

Laundry washing machines typically use a rotating drum to agitate the clothes being washed. Turning to FIG. 1, which contains cutaways to aid visibility, washing machine 10 has drum 12, which rotates around horizontal axis 14. Clothing load 18 is contained within drum 12. After clothing load 18 has been taken through the washing and rinsing cycles, it is necessary to remove excess water before the clothes can be removed and placed in a dryer. This goal is typically accomplished by rotating drum 12 at a relatively high speed, so that centrifugal acceleration forces clothing load 18 against the interior surface 20 of drum 12. As the rotation of drum 12 is continued, the water within clothing load 18 flows out through perforations in interior surface 20, and is removed via channeling means within drum 12 (not shown).

While many methods are employed to ensure even distribution of clothing load 18, load imbalance is a frequent problem. If clothing load 18 is not evenly distributed, the resulting imbalance will cause a vibration while drum 12 is spinning. If the imbalance is significant, this vibration can cause the rotating drum 12 to strike chassis 16, resulting in damage to the machine. Thus, the detection of an imbalanced load is important for safe operation of washing machine 10.

Several methods have been previously used to detect an unbalanced condition. First, mechanical limit switches ("trembler" switches) can be mounted on chassis 16 to detect an unbalanced load. If sufficient vibration builds, the "trembler" switch will make contact and the resulting circuit is used to trigger a shut-down of the machine.

The same result can be accomplished with an electrical accelerometer switch. This type of device measures oscillating acceleration (vibration) by measuring the mechanical force induced in a load cell. Like the trembler switch, it sends a shut-down signal if a fixed vibration threshold is exceeded.

Yet another method of detecting load imbalance is to monitor the variation in drive motor load when drum 12 is rotated at low speed. FIG. 2 shows a simplified rear view of washing machine 10. Drum pulley 22 is attached to the rear of drum 12. Drive motor 28 is mounted to chassis 16, in the area below drum 12. Drive motor 28 has motor pulley 24, which drives drive belt 26. Drive belt 26, in turn, drives drum pulley 22, which drives drum 12. An imbalanced load in drum 12, will therefore cause a variation in the load experienced by drive motor 28. In order to understand this phenomenon, the reader's attention is directed to FIG. 3.

FIG. 3 shows a front view of washing machine 10, again in simplified form. The imbalanced load is represented by a single unbalanced mass 30. Drum 12 is spinning in the direction indicated by the arrow. When unbalanced mass 30 is in the position depicted in FIG.3, the gravitational force on unbalanced mass 30 (Fw), opposes the driving torque of drive motor 28, thereby increasing the load. When unbalanced mass 30 is in the position depicted in FIG. 4, the gravitational force acts in the same direction as the driving torque, thereby decreasing motor load. The result is a sinusoidal variation in motor load, resulting from the raising and lowering of unbalanced mass 30 within the earth's gravitational field. The reader will appreciate that this phenomenon is only observed in washing machines having an off-vertical spin axis. For a machine having a purely vertical spin axis, there will be no load variation caused by gravity.

The magnitude of the load variation within drive motor 28 is proportional to the magnitude of unbalanced mass 30. Thus, if the load variation can be accurately sensed, the magnitude of the imbalance can be determined. The variation in motor load will cause a small variation in motor speed. If drive motor 28 is equipped with an accurate tachometer, it is possible to measure this variation in speed, and it is therefore possible to calculate the magnitude of the imbalanced load. This magnitude is then used to determine whether the load is sufficiently well balanced to initiate the spin cycle. This method is typically employed at a relatively low spin speed in order to detect any imbalance before the vibration has built to a dangerous level. If the load is sufficiently well balanced, drum 12 would then be accelerated to the speed normally used during the spin cycle.

All of these methods, consisting of the trembler switch approach, the accelerometer approach, and the motor load sensing approach, traditionally result in a "GO/NO-GO" decision on the spin cycle. If clothing load 18 is sufficiently balanced, the machine will proceed to the spin cycle. If clothing load 18 is not sufficiently balanced, several things may occur. Many machines are programmed to stop and then begin a series of motions intended to redistribute the load. Other machines will simply shut down and await operator intervention. Even for those machines with provisions for an attempted redistribution, the redistribution will only be attempted a few times before the machine shuts down. The result is that a significantly imbalanced load will cause the machine to shut down before the spin cycle, meaning that clothing load 18 will be left soaking wet. The operator often discovers the machine in a seemingly inoperative condition and, unaware that it needs to be reset, places a needless service call. Additionally, the three approaches described require the use of an extra sensor or sensors, thereby adding cost and reliability concerns.

A more sophisticated solution is described in U.S. Pat. No. 5,161,393 to Payne et. al. (1994). The Payne device seeks to calculate the load imbalance, and then use this value to select among several available terminal spin speeds in order to ensure that a maximum permissible vibration is not exceeded. It calculates the load imbalance in a two-step process. First, the device applies a fixed torque to the spinning drum at relatively low speed (approximately 30 to 50 rpm) and measures the time interval required to accelerate the drum to 250 rpm. This time measurement is used to calculate the moment of inertia of the load within the drum, and thereby obtain an approximate value for its mass. The reader should note that, over this relatively low speed range, the time interval is not significantly sensitive to load imbalance; i.e., an imbalanced load will accelerate at nearly the same rate as a balanced one. Thus, the first time interval is measured to determine mass, irrespective of imbalance.

As the drum is accelerated past 250 rpm, a significant load imbalance will retard the acceleration of the drum. This phenomenon is illustrated by FIG. 29 in the Payne et.al.

disclosure. An unbalanced load will take longer to accelerate from 250 to 600 rpm, as shown by the diverging angular velocity curves. This information, when used in conjunction with the total load information obtained during the acceleration from low speed to 250 rpm, is used to determine the imbalance. The magnitude of the imbalance is then used to determine what maximum spin speed will be selected from among several discrete available speeds.

The Payne et.al. invention does require reasonably accurate measurement of drum speed and elapsed time. These requirements do not necessarily necessitate additional sensors, however. The reader will note from the Payne et.al. disclosure that the spinning drum is directly coupled to an electric drive motor. The motor controller would typically have time and motor speed sensing means. Thus, by monitoring existing functions of the motor controller, it is possible to determine drum speed and elapsed time without the need for additional sensors. The reader will therefore appreciate that the methodology disclosed in Payne et.al. can be implemented without additional sensors.

The Payne et.al. method is not without its limitations, however. It is not capable of measuring the load imbalance with sufficient accuracy to determine precisely what the terminal spin velocity should be. Rather, it is only capable of measuring the imbalance with enough accuracy to determine whether the load will accelerate smoothly through one of several natural frequencies inherent to the machine. The possible terminal spin speeds are shown in FIG. 28 of the disclosure. This accuracy limitation was acceptable in its field of application - primarily residential washing machines. However, a method of more accurately determining load imbalance so that a continuously variable terminal spin speed could be calculated, is certainly preferable.

The known methods for dealing with load imbalance in a laundry washing machine are therefore limited in that they:

1. Require additional sensors, thereby adding cost to the machine;
2. Provide only a "GO/NO-GO" decision on the spin cycle;
3. Result in a machine shut-down, with consequent needless service calls; and
4. Do not provide enough accuracy in the measurement of the load imbalance.

OBJECTS AND ADVANTAGES

Accordingly, several objects and advantages of the present invention are:

(1) to measure the imbalance in the spinning load without the need for additional sensors;

(2) to provide adjustment of the terminal spin speed over a continuous range, rather than choosing from a few discrete spin velocities;

(3) in the event of a significant load imbalance, to provide for a reduced terminal spin speed, rather than a machine shutdown; and (4) to measure the load imbalance with sufficient accuracy to calculate the appropriate terminal spin speed.

DRAWING FIGURES

Figure 1:
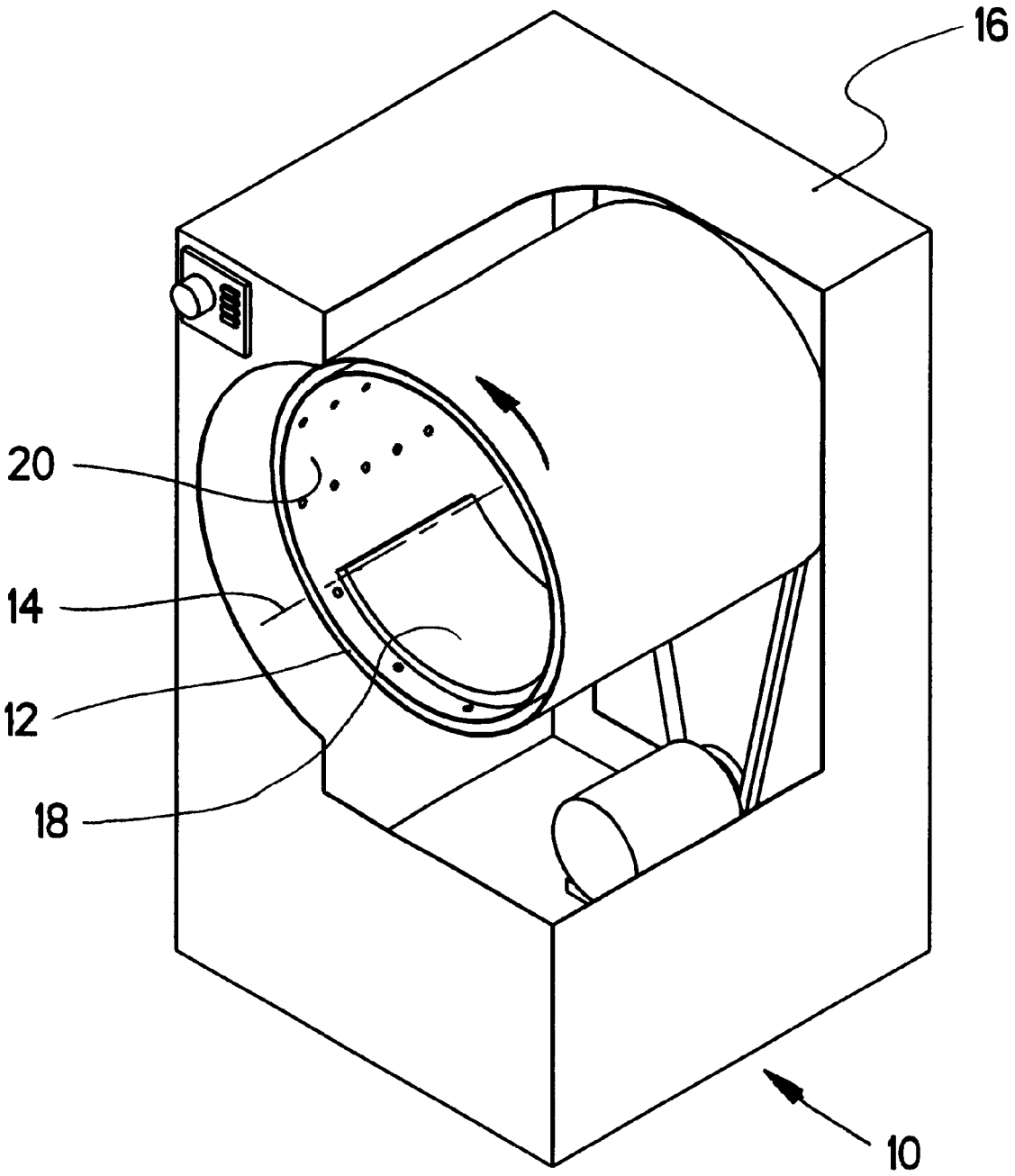
FIG. 1 is an isometric view with cutaways, showing a simplified representation of a horizontal-axis laundry washing machine.

| Reference Numerals in Drawings | |
|---|---|
| 10 washing machine | 12 drum |
| 14 horizontal axis | 16 chassis |
| 18 clothing load | 20 interior surface |
| 22 drum pulley | 24 motor pulley |
| 26 drive belt | 28 drive motor |
| 30 unbalanced mass | 32 motor drive voltage |
| 34 motor terminal current | 36 power phase lag |
| 38 balanced torque load | 40 unbalanced torque load |
| 42 balanced angular velocity | 44 unbalanced angular velocity |
| 46 balanced power phase angle | 48 unbalanced power phase angle |
| 50 angular acceleration | 52 drive motor torque |
| 54 linear slip range | 56 zero slip point |
| 60 angular velocity amplitude | |

SUMMARY OF THE INVENTION

The present invention seeks to optimize the maximum angular velocity employed for drum 12 during the water extraction, or "spin" cycle. The principal unknown is the magnitude of unbalanced mass 30, within clothing load 18.

An additional unknown of some significance is the moment of inertia of clothing load 18 when it is saturated. The moment of inertia will be impossible to accurately determine, since there is no means provided to sense the total mass of clothing load 18. Thus, the method disclosed seeks to determine the magnitude of unbalanced mass 30 without having to know the total mass of clothing load 18.

The magnitude of unbalanced load 30 is calculated from the variations in the angular velocity of drum 12 while it is spun at a relatively low angular velocity. Once the magnitude of unbalanced mass 30 is known, it is possible to calculate the maximum angular velocity to be employed in the water extraction cycle for that load. The value for the maximum angular velocity is stored in memory, and drum 12 is then accelerated to that angular velocity for the water extraction cycle.

Since an additional sensor would be needed to directly measure angular velocity, the method disclosed seeks to indirectly determine angular velocity by measuring other values which can be determined without additional sensors. The other values which may be used to determine angular velocity are: motor torque, motor current, motor power phase angle, and motor slip. The techniques used to measure these values and thereby determine the magnitude of unbalanced mass 30 will be explained in separate sections.

DETAILED DESCRIPTION

The primary goal of the present invention is to maximize the angular velocity of drum 12 during the water extraction cycle, while keeping vibration transmitted to chassis 12 within an acceptable range. The vibration force induced when drum 12 is spun with unbalanced mass 30 contained therein, is represented by the expression:

$$F_v = M_i * r * \omega^2 \quad \text{(Equation 1)}$$

where $F_v$ refers to the magnitude of the vibration force, $M_i$ refers to the magnitude of unbalanced mass 30, r refers to the radius of drum 12, and ω refers to the angular velocity of drum 12. $F_v$ is established for the design of the entire machine, and it is based on the maximum vibration load the machine is intended to routinely handle. A typical value for $F_v$ would be 250 Newtons. The expression shown above may then be rewritten to solve for angular velocity as follows:

$$\omega = \sqrt{F_{v/(M_i * r)}} \quad \text{(Equation 2)}$$

Thus, so long as $F_v$ has been established, ω may be calculated for each value of $M_i$. The value of ω then corresponds to the maximum angular velocity of drum 12 which will not exceed $F_v$ for a given $M_i$. A method for determining the magnitude of unbalanced mass 30 is therefore of critical importance.

Figure 10:
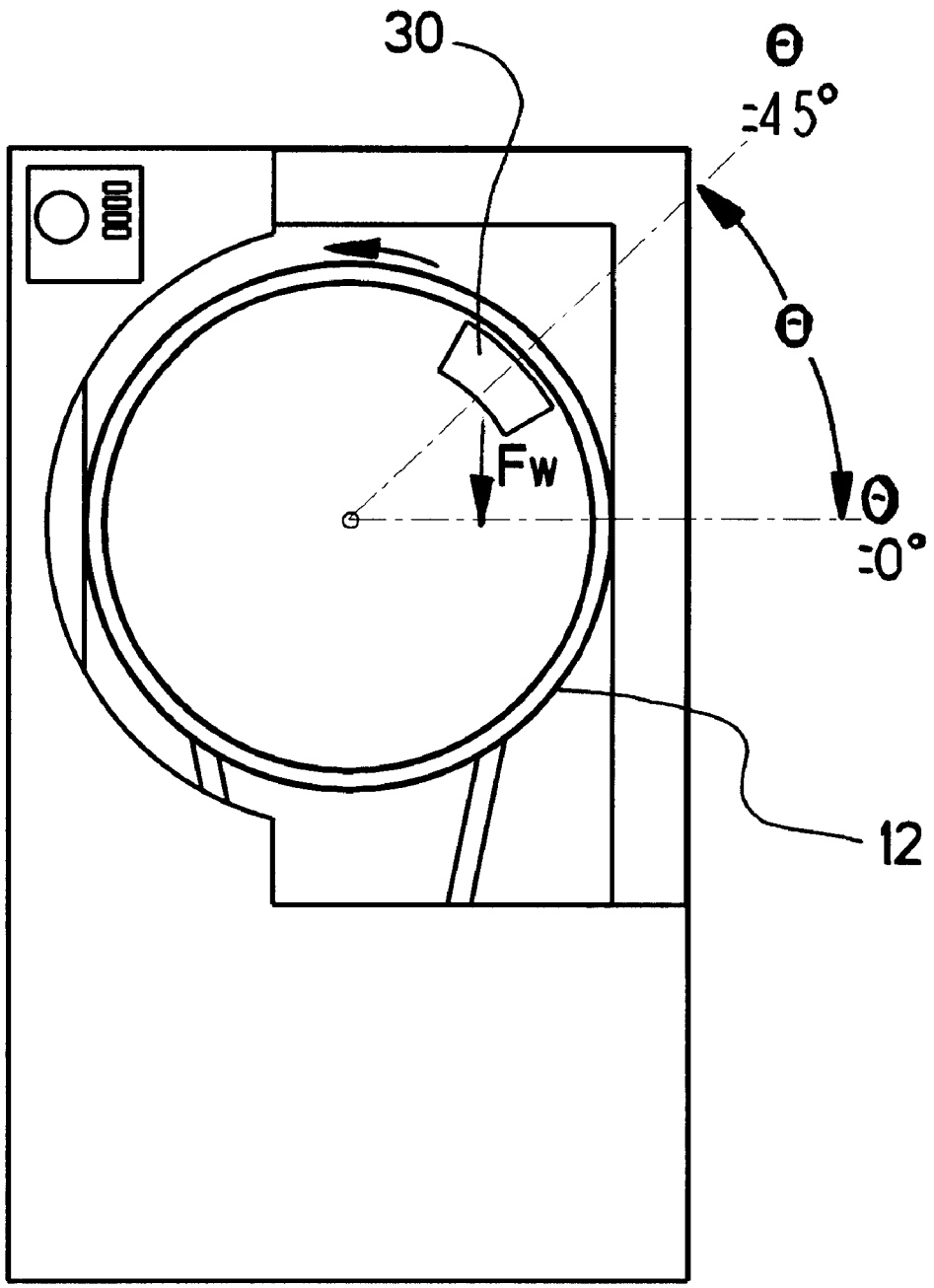
FIG. 10 is a simplified elevation view of the laundry washing machine, illustrating the measurement of angular displacement.

The first step in determining $M_i$ is to develop an expression for the angular acceleration experienced by drum 12 when it is spinning with unbalanced mass 30. Turning now to FIG. 10, the reader will observe that unbalanced mass 30 exerts a torque on drum 12, as a result of its weight (Fw). The equation describing this torque resulting from unbalanced mass 30 may be written as:

$$T_i = M_i * g * r * \cos(\theta) \quad \text{(Equation 3)}$$

where "g" is the acceleration due to gravity, "r" is the radius of drum 12, and "θ" is the angular displacement in a counterclockwise direction, starting from the axis shown.

Drum 12 also experiences torque as a result of friction in its bearing supports, which is linearly proportional to the angular velocity of drum 12. This torque may be written as:

$$T_f = -kf * \omega \quad \text{(Equation 4)}$$

where "kf" is the coefficient of friction.

Finally, drum 12 experiences torque delivered by drive motor 28, which will be represented by the variable $T_d$. Thus, the summation of the torques acting on drum 12 may be written as:

$$\Sigma T = T_d - T_f - T_i \quad \text{(Equation 5)}$$

or $$\Sigma T = T_d - kf * \omega - M_i * g * r * \cos(\theta) \quad \text{(Equation 6)}$$

The angular acceleration of drum 12 is equal to ΣT divided by the total rotational moment of inertia of the rotating system. This equation may be written as:

$$\alpha = 1/I_t * \Sigma T \quad \text{(Equation 7)}$$

where α is the angular acceleration of drum 12, and $I_t$ is the total rotational moment of inertia of the system. Substituting in the expression for ΣT gives the following expression for angular acceleration of drum 12:

$$\alpha = 1/I_t * (T_d - kf * \omega - M_i * g * r * \cos(\theta) \quad \text{(Equation 8)}$$

Figure 5:
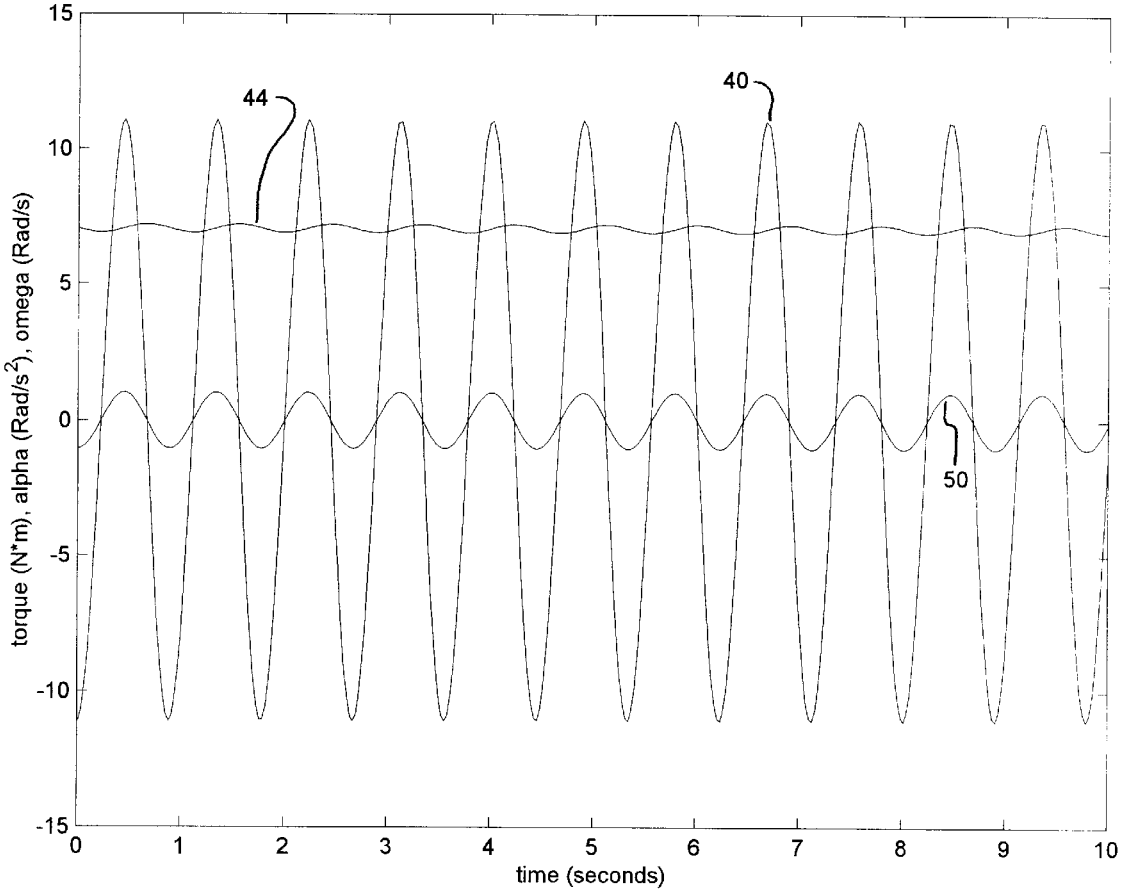
FIG. 5 is a plot of torque, angular acceleration, and angular velocity vs. time.

This expression is in the form of a differential equation. FIG. 5 shows an exemplary curve for angular acceleration 50 versus time. The curve shown is for the time period after drum 42 has accelerated to reach a steady angular velocity 44 (apart from the sinusoidal variation caused by unbalanced mass 30).

It is easier to perceive the wave shape of angular acceleration 50 and angular velocity 44 when drum 12 is spinning at a relatively low angular velocity. However, it is also necessary to spin drum 12 fast enough for centrifugal force to pin clothing load 18 firmly against interior surface 20, thereby preventing constant redistribution of clothing load 18. Practical experience has shown that the centrifugal acceleration needed to accomplish this task is approximately 2 G's. Drum 12 has a radius of 0.394 m. This fact means that the angular velocity needed to produce a centrifugal acceleration of 2 G's on clothing load 18 is 7.059 Radians/s (67.4 RPM).

Thus, the first step in the process of determining a value for unbalanced mass 30 is to have drive motor 28 apply torque to drum 12 until it reaches a steady average angular velocity of around 67 RPM. FIG. 5 shows the resulting curves for angular acceleration 50, unbalanced angular velocity 44, and unbalanced torque load 40, in this state of drum 12. As was stated previously in this disclosure, one goal of the present invention is to measure the value of unbalanced mass 30 without requiring the use of additional sensors. There is, in fact, enough information contained in the curves shown in FIG. 5 to determine a good approximation for unbalanced mass 30. The magnitude of unbalanced mass 30 could actually be determined using any one of the three curves, though different sensing techniques are required. Each possibility will be explained.

DETAILED DESCRIPTION

MOTOR TERMINAL CURRENT METHOD

Unbalanced torque load 40 may, as has been previously explained, be represented by the following expression:

$$\Sigma T = T_d - kf * \omega - M_i * g * r * \cos(\theta) \quad \text{(Equation 6)}$$

At the point where an average angular velocity has reached a steady state, $T_d$ will be very nearly equal to the frictional torque (kf*ω). Because unbalanced angular velocity 44 is varying sinusoidally, the two terms will not be exactly equal at all points in time. But, since the variation is small in relation to the overall magnitude, we may assume that the two terms are equal without introducing significant error. Therefore, setting $T_d$ equal to kf*ω gives the following simplified expression:

$$\Sigma T=-M_i*g*r*\cos(\theta) \quad \text{(Equation 9)}$$

ΣT is therefore a function of angular displacement (θ). The approximate maximum value for ΣT may be found by setting cos(θ)=−1. The following expression results:

$$(\Sigma T)_{max}=M_i*g*r \quad \text{(Equation 10)}$$

where $(\Sigma T)_{max}$ represents a maximum value. If $(\Sigma T)_{max}$ can be measured, $M_i$ can then be determined using the same equation, manipulated algebraically:

$$M_i=(\Sigma T)_{max}/(g*r) \quad \text{(Equation 11)}$$

Figure 2:
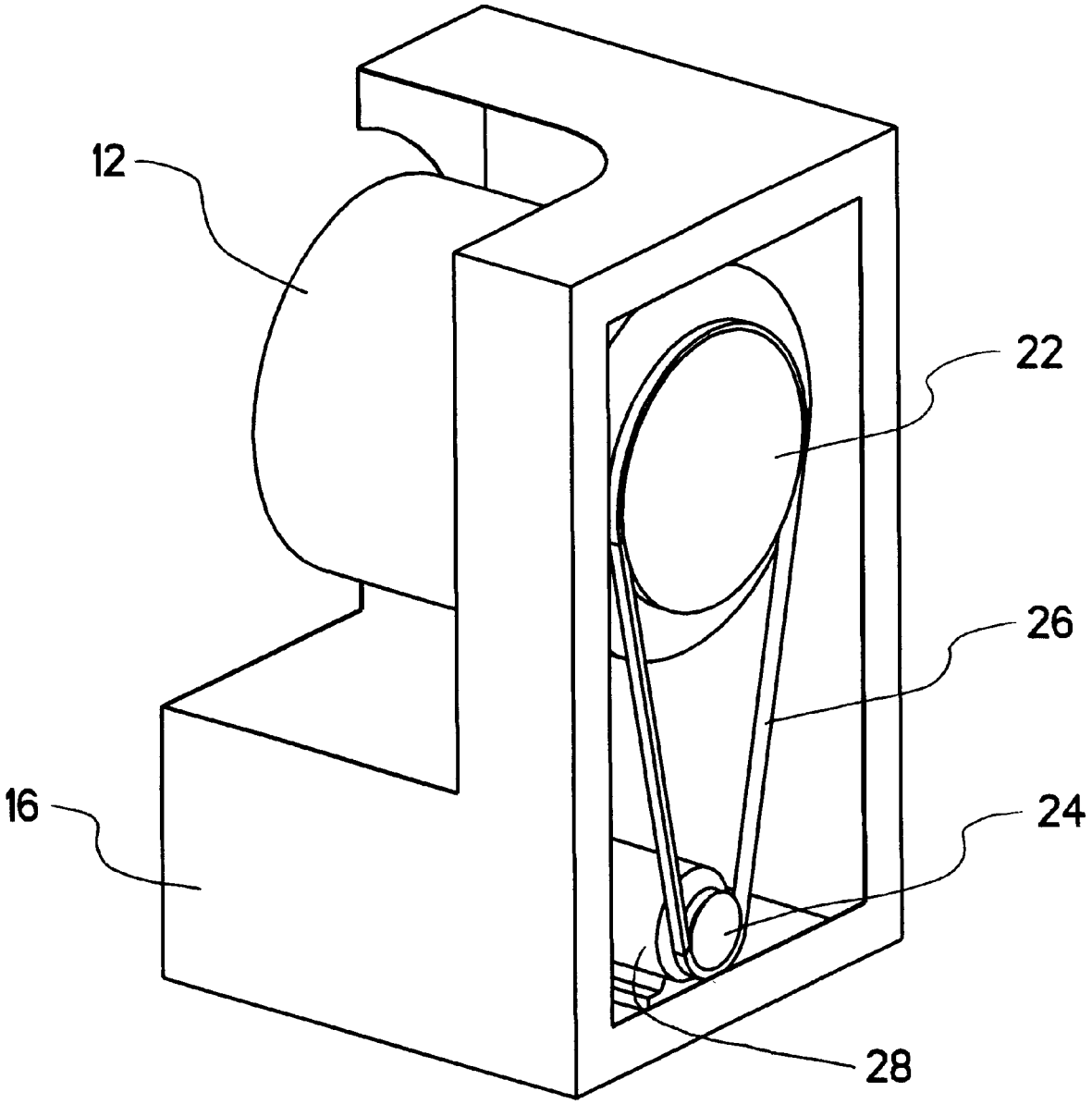
FIG. 2 is an isometric view with cutaways, showing a rear view of the same machine depicted in FIG. 1.
Figure 3:
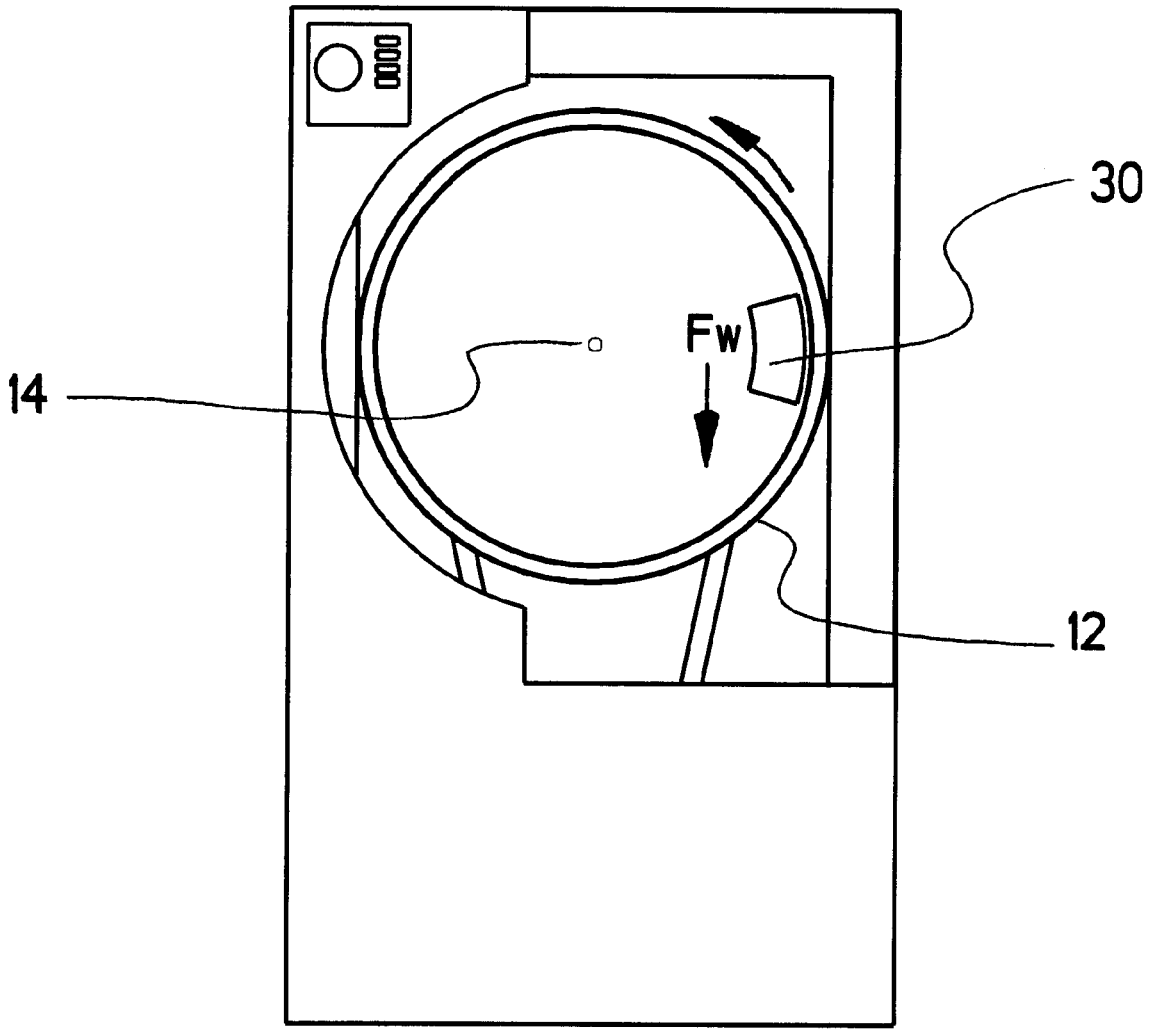
FIG. 3 is a simplified elevation view, showing the effect of an unbalanced mass in the spinning drum.
Figure 4:
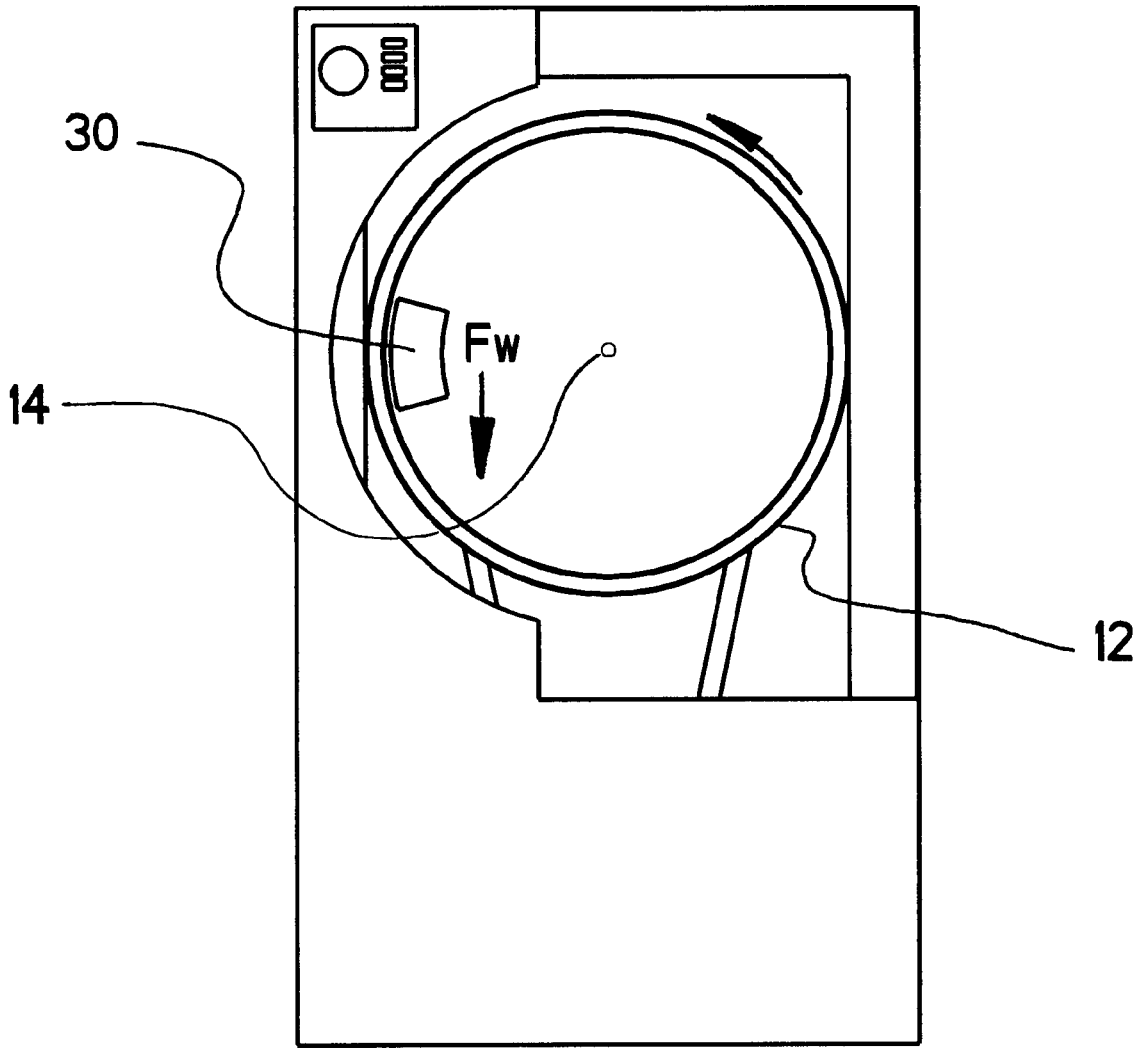
FIG. 4 is a simplified elevation view, showing the effect of an unbalanced mass in the spinning drum.
Figure 6:
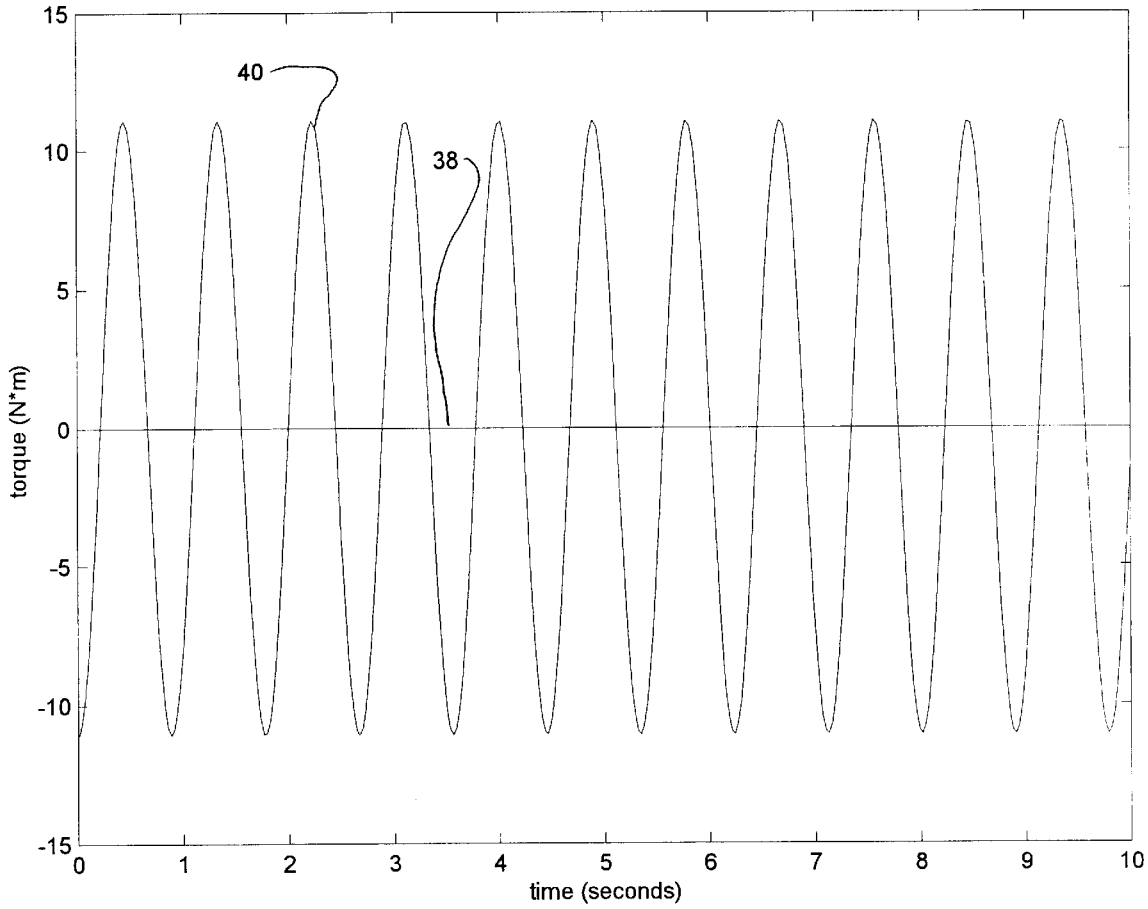
FIG. 6 is a plot of torque vs. time.

FIG. 6 graphically illustrates the variation in torque caused by unbalanced mass 30. Unbalanced torque load 40 is seen to vary sinusoidally from balanced torque load 38. In order to calculate $M_i$, an accurate measurement must be made of the torque applied to drum 12. This measurement could be accomplished using a piezoelectric load cell, measuring strain on the shaft driving drum 12. It could also be made by a spring-biased angular displacement sensor. However, as drum 12 is rotating rapidly, it would be difficult to get the measured data back out to the stationary control circuitry (necessitating the use of slip rings, or the like). Turning briefly to FIG. 2, the reader will recall that drive motor 28 is directly coupled to drum 12 by drive belt 26. Thus, if the torque variation in drive motor 28 can be accurately measured, this may be easily converted to represent the torque variation in drum 12. The reader will note that drive motor 28 spins considerably faster than drum 12. The reduction ratio employed is approximately 9 to 1. Thus, torque measured at drive motor 28 will have to be multiplied by the reduction ratio to get an equivalent torque at drum 12. A torque measurement taken at drive motor 28 may then be used to determine the torque at drum 12, and then the magnitude of unbalanced mass 30 by using Equation 11.

Unfortunately, It is undesirable to measure actual torque at drive motor 28, because a complex mechanical sensor would be required—adding expense to the system. However, it is possible to approximate the actual torque at drive motor 28 by measuring motor terminal current 34 within drive motor 28.

Figure 11:
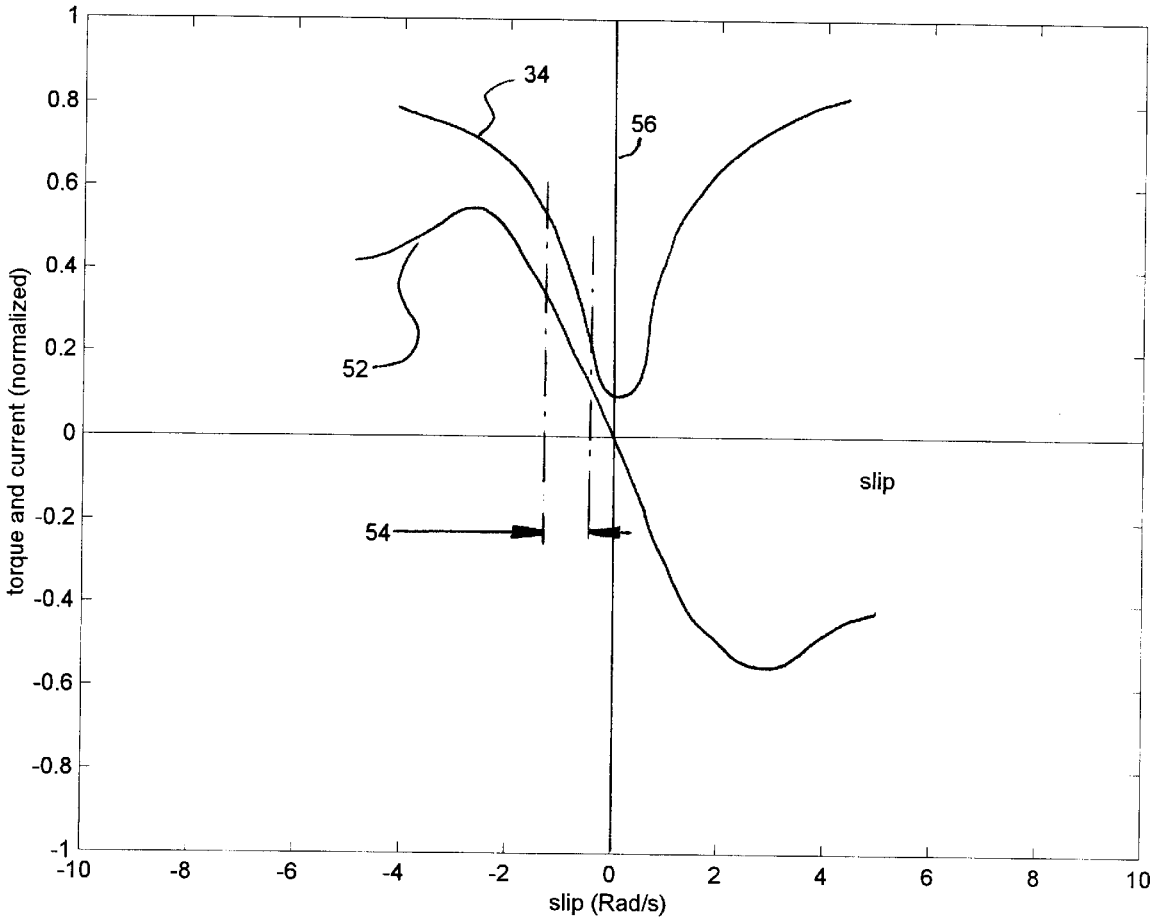
FIG. 11 is a plot of motor current and motor torque vs. slip.

The reader is referred to FIG. 11, which shows the characteristic drive motor torque 52 and motor terminal current 34 for drive motor 28 as a function of slip. "Slip" is a term commonly understood in the art. It is equal to the input frequency of the voltage driving the motor minus the operating frequency of the motor. Drive motor 28 is typically an induction motor. The excitation, or "field" winding of drive motor 28 will be driven at the input frequency of the applied voltage. The resulting magnetic field rotates within drive motor 28 at the same rate as the input frequency of the voltage applied; i.e., if the voltage applied has a frequency of 1.1 Hz, the field will rotate within drive motor 28 at the rate of 1.1 Hz, or 1.1 revolutions per second.

The armature of drive motor 28 will rotate at a slightly lower speed. In a sense the armature of drive motor 28 is always "chasing" the rotating magnetic field, which is revolving at a slightly faster rate. Viewed from an energy balance perspective, it is this difference in speed that causes the motor to produce torque. With these principles in mind, FIG. 11 will now be explained in detail.

Zero slip point 56 represents the point where the armature speed of drive motor 28 is exactly equal to the speed of the revolving excitation field. The reader will observe that at zero slip point 56, drive motor 28 produces no torque. If the armature speed of drive motor 28 actually exceeds the speed of the revolving excitation field (which is the region to the right of zero slip point 56 on FIG. 11), drive motor 28 will produce a negative torque—meaning that it is operating as a generator rather than a motor. If the armature speed of drive motor 28 is lower than the speed of the revolving excitation field (which is the region to the left of zero slip point 56 on FIG. 11), drive motor 28 will produce a positive torque.

For the purposes of driving drum 12, drive motor 28 must obviously be operated as a motor—meaning it will be operated within the region of FIG. 11 to the left of zero slip point 56. It is also desirable to minimize motor terminal current 34 within drive motor 28, in order to reduce heat build-up from resistance losses. Likewise, it is important to obtain fairly large torque output from drive motor 28. These two concerns, taken together, mean that it is desirable to operate drive motor 28 within the region of FIG. 11 denoted as linear slip range 54.

Over linear slip range 54, drive motor torque 52 and motor terminal current 34 are very nearly linear. They may, in fact, be approximated by a linear function without introducing significant error. From inspecting FIG. 11 over linear slip range 54, the reader will observe that if motor terminal current 34 is known, drive motor torque 52 may be calculated by multiplying motor terminal current 34 by a fixed scalar. This operation may be expressed as:

$$T_{motor}k1*I_{motor} \quad \text{(Equation 12)}$$

where k1 is a fixed scalar, and $I_{motor}$ is motor terminal current 34. It is therefore possible to develop a plot for $T_{motor}$ on the basis of motor terminal current 34, which will look like the plot of unbalanced torque load 40 shown in FIG. 5. A small error will be introduced, because neither of the two curves is truly linear, but the error can be ignored as insignificant.

Thus, by measuring motor terminal current 34, an approximate plot for $T_{motor}$ can be created. $T_{motor}$ is directly related to ΣT (the sum of the torques acting on drum 12) by the drive ratio. Thus, in the case of a 9 to 1 drive ratio, ΣT is equal to 9 times $T_{motor}$. The approximate plot for ΣT is then easily created from the plot for $T_{motor}$. Many conventional techniques may then be used to determine the amplitude of the variation in $T_{motor}$. Once the torque amplitude is known, it can be fed into the equation previously developed for determining unbalanced mass 30 ($M_i$) as follows:

$$M_i=(\Sigma T)_{max}/(g*r) \quad \text{(Equation 13)}$$

where $(\Sigma T)_{max}$ is equal to the torque amplitude. A value for unbalanced mass 30 is thereby obtained. This value, in conjunction with the given value for $F_v$, may then be used to determine the maximum angular velocity of drum 12 which should be used during the water extraction cycle. The previously developed expression for the maximum angular velocity (ω) is:

$$\omega=\sqrt{F_{v/(M_i*r)}} \quad \text{(Equation 2)}$$

Thus, the reader will understand that by measuring motor terminal current 34 while drum 12 is being spun at a relatively low angular velocity (approximately 67 RPM), a good approximation of torque amplitude may be obtained, and from thence the magnitude of unbalanced mass 30 can be calculated. The optimum terminal angular velocity for drum 12 during the water extraction cycle can then be calculated.

However, the reader should be aware that actually sensing the current in the motor winding is a difficult proposition. Because an electric motor is a highly inductive load, the current response may be sluggish in comparison to variations in torque and applied voltage. Thus, for many drive motors, if the torque variation is quite rapid, it will be difficult to "see" this variation by measuring variations in motor current. At a minimum, measuring motor current would require an additional sensor of some complexity. Thus, another approach would be preferable.

DETAILED DESCRIPTION

Slip Measurement Method

Referring back to FIG. 11, it may be observed that motor torque is nearly linearly proportional to slip over linear slip range 54. Thus, if a value for slip can be obtained, then a value for motor torque can be calculated. In the preceding section, it was explained how a value for the magnitude of unbalanced mass 30 could be calculated once the amplitude of the variation in motor torque is known. Thus, if a value for the amplitude of slip can be obtained, a value for the magnitude of unbalanced mass 30 can be calculated.

If an accurate tachometer is placed on the armature shaft of drive motor 28, then the actual angular velocity of the armature shaft can be measured. The angular velocity of the armature shaft can easily be converted to a frequency using the expression $f=\omega_a/(2*\Pi)$, where $\omega_a$ is the angular velocity of the armature expressed in Radians/s. The frequency of the input voltage to drive motor 28 is known, because it is determined by the motor controller circuitry. Slip is then the difference between the two frequencies. The value for slip can then be converted to a value for motor torque by using a linearized approximation of drive motor torque 52 shown in FIG. 11.

While the slip measurement method does work, it requires the use of a tachometer on drive motor 28. Further, this tachometer will have to have a very accurate resolution in order to measure the subtle variations in angular velocity caused by unbalanced mass 30. It would therefore add considerable cost to the system. Once again, another approach would be preferable.

DETAILED DESCRIPTION

Power Phase Angle Method (Preferred Embodiment)

Referring back to FIG. 5, it may be observed that unbalanced angular velocity 44 varies sinusoidally, at the same frequency as unbalanced torque load 40. Thus, it should be possible to obtain an approximate value for unbalanced mass 30 by evaluating the curve for unbalanced angular velocity 44. This is in fact the case, as will be explained in this section.

Accurate measurement of unbalanced angular velocity 44 may be obtained by placing a tachometer on drum 12 or drive motor 28. Such a tachometer would constitute an additional unwanted expense, however. As one of the stated goals of the present invention is to avoid the need for additional sensors, another method of measuring unbalanced angular velocity 44 is preferable.

Figure 7:
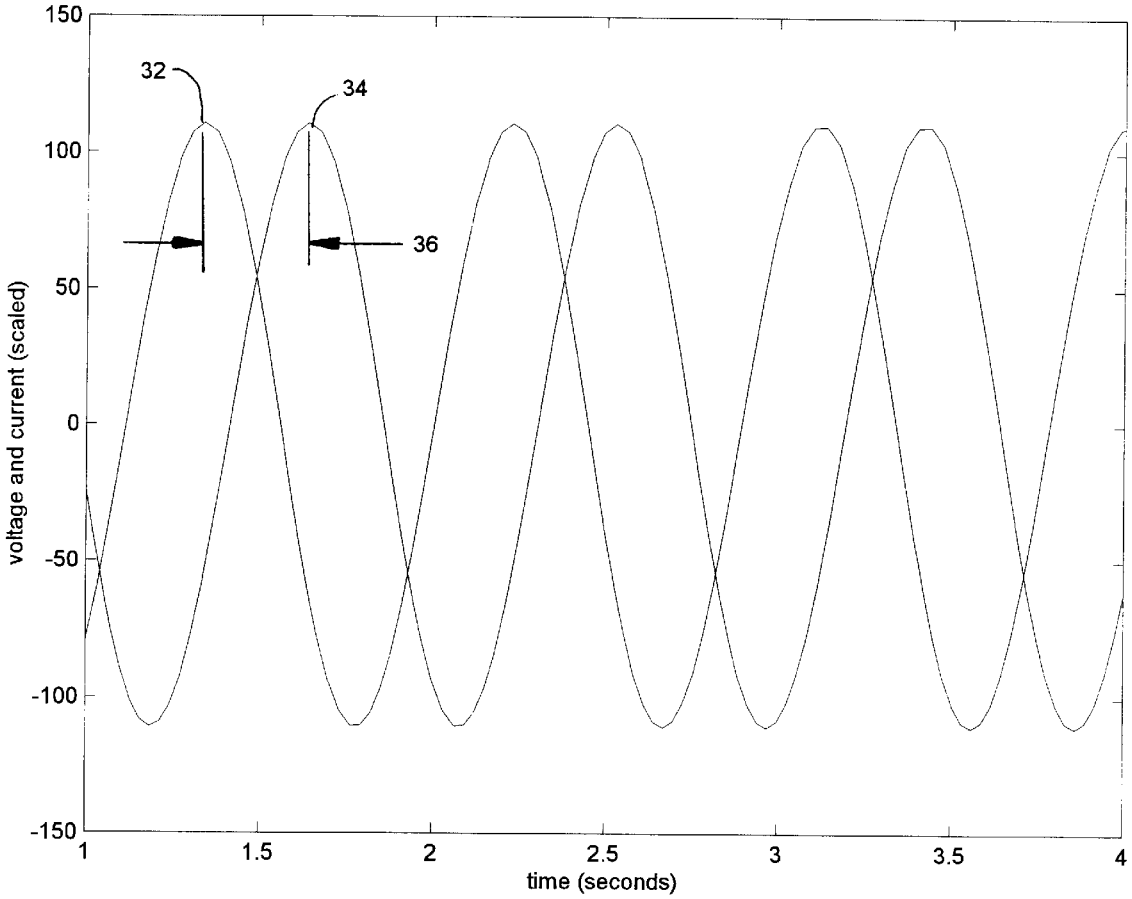
FIG. 7 is a plot of motor voltage and motor current vs. time.

FIG. 7 shows exemplary curves for motor drive voltage 32 and motor terminal current 34, where "motor drive voltage" is the voltage applied to drive motor 28, and "motor terminal current" is the resulting current in the field winding. Motor terminal current 34 is related to motor drive voltage 32 by Ohm's law. However, as drive motor 28 represents a highly inductive load, motor terminal current 34 will always lag behind motor drive voltage 32, as is shown graphically in FIG. 7. The phase lag of motor terminal current 34 is referred to as power phase lag 36. The reader will no doubt be aware that voltage and current do not have the same units, and that one would not expect a plot of these two values to show the same amplitude. The plots of the two exemplary curves depicted in FIG. 7 have been scaled to give them matching amplitudes, which aids visual understanding of the phase lag phenomenon.

Power phase lag 36 is directly proportional to the angular velocity of drive motor 28. This fact is well known in the art, and follows from a simple understanding of inductive loads. As the angular velocity of drive motor 28 is increased, the frequency of motor drive voltage 32 must also increase. This fact means that the voltage is cycling between its positive and negative extremes at a faster and faster rate. The current induced by the voltage therefore tends to lag further behind the voltage as motor speed increases. This fact is critical, because it means that if one knows the value for power phase lag 36 one can develop a value for the angular velocity of drive motor 28, and from thence a value for the angular velocity of drum 12.

The reader should be aware that power phase lag 36 is often expressed in terms of a "power phase angle." The value for the power phase angle, which is a common term within the art, is developed from power phase lag 36 by the following expression:

$$\Phi=(\text{power phase lag})*f*2*\Pi \qquad \text{(Equation 14)}$$

where "Φ" represents the power phase angle, and "f" represents the frequency of motor drive voltage 32. The "2*Π" term is included in order to express the result in radians, which is the unit typically used.

The electronic controller used to provide voltage to drive motor 28 is commonly called a Pulse Width Modulated Inverter Drive ("PWM Inverter Drive"). While an explanation of the operation of a PWM Inverter Drive is beyond the scope of this disclosure, the reader is referred to U.S. Pat. No. 5,627,447 to Unsworth et.al. (1997), which contains an excellent description. The disclosure of the Unsworth et.al. device describes how power phase lag, and therefore power phase angle, may be determined using existing components within the PWM Inverter Drive. The reader should be advised that the Unsworth et.al. disclosure refers to the power phase angle as the "current phase angle," a synonymous term.

It is the intention of the present inventors to incorporate the PWM Inverter Drive disclosed in Unsworth et.al. in their present invention. The Unsworth et.al. device will provide the amplitude of the variation in the power phase angle. Thus, the reader will appreciate that the measurement of the amplitude of the variation in the power phase angle may be accomplished using the existing motor controller, and without the need for additional external sensors. The value for the amplitude of variation in the power phase angle may then be used to calculate the magnitude of unbalanced mass 30, as will be explained in the following.

The amplitude of variation in the power phase angle is directly proportional to the amplitude of variation in the angular velocity of drum 12. This expression may be written as:

$$(\omega)_{amplitude}=k2*(\Phi)_{amplitude} \qquad \text{(Equation 15)}$$

Figure 8:
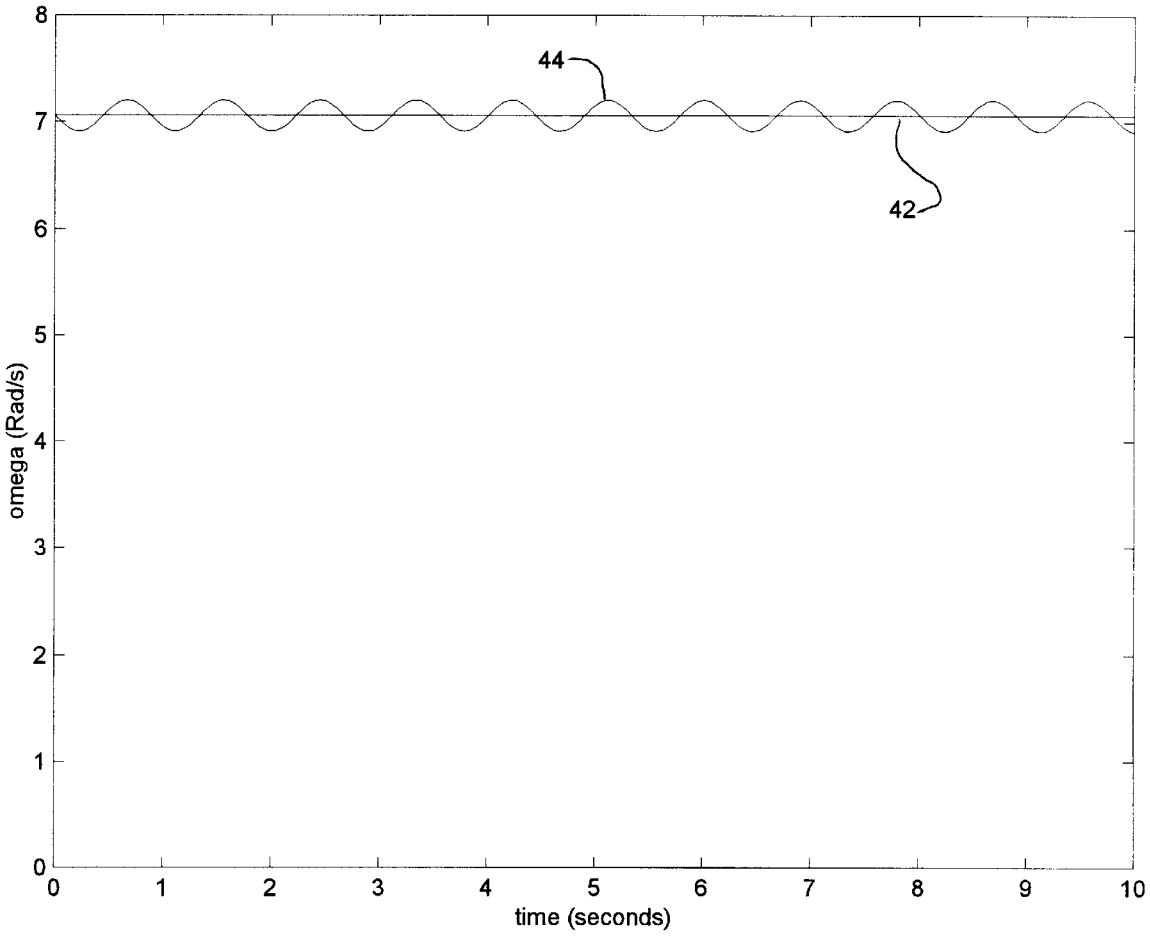
FIG. 8 is a plot of angular velocity vs. time for a balanced load and an unbalanced load.

FIG. 8 shows a plot of angular velocity for drum 12. The plot shows angular velocity after it has reached an average value of 7.059 Rad/s (67 RPM), which is the relatively low speed found suitable for determining the magnitude of unbalanced mass 30. Drum 12 is not experiencing acceleration, other than that caused by unbalanced mass 30. Unbalanced angular velocity 44 is seen to vary sinusoidally from the flat curve of balanced angular velocity 42. The curve labeled 42 results from a perfectly balanced drum. The curve labeled 44 results from the introduction of unbalanced mass 30.

Figure 9:
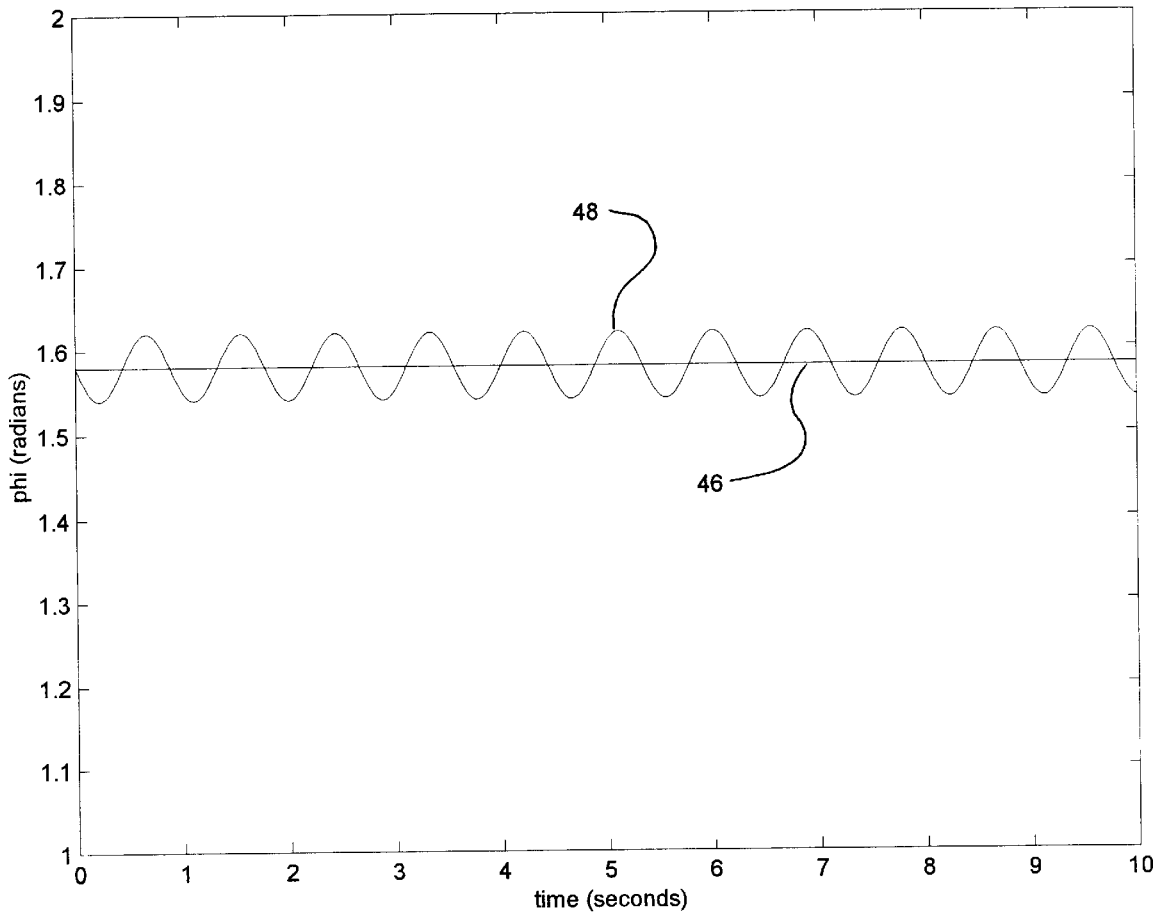
FIG. 9 is a plot of power phase angle vs. time for a balanced load and an unbalanced load.

FIG. 9 shows the variation in power phase angle (Φ) for the same state. Unbalanced power phase angle 48 is observed to vary sinusoidally from balanced power phase angle 46, with the same frequency as unbalanced angular velocity 44 shown in FIG. 8. From studying FIGS. 8 and 9, the reader will observe that the unbalanced power phase angle 48 does indeed vary linearly with unbalanced angular velocity 44. By measuring the amplitude of unbalanced power phase angle 48, it is possible to determine the amplitude of unbalanced angular velocity 44, as demonstrated by Equation 15. This fact is significant, because if the amplitude of unbalanced power phase angle 48 is known, it is possible to determine the amplitude of unbalanced angular velocity 44, and then the magnitude of unbalanced mass 30.

FIGS. 13 through 17 illustrate the effect that variations in the magnitude of unbalanced mass 30 has on $(\omega)_{amplitude}$. In every figure, drum 12 is rotating with an average angular velocity of 7.059 Rad/s (67 RPM). The total clothing load is constant at 15 kg. For FIG. 13, unbalanced mass 30 had a magnitude of 1 kg. The resulting amplitude of the variation in angular velocity is 0.542 Rad/s. For FIG. 14, the magnitude was increased to 2 kg. The resulting amplitude variation was then 0.1089 Rad/s. The following table aids the comprehension of these results:

| FIG. | $M_i$ | $(\omega)_{amplitude}$ (Rad/s) |
|---|---|---|
| 13 | 1.0 | .0542 |
| 14 | 2.0 | .1089 |
| 15 | 3.0 | .1629 |
| 16 | 4.0 | .2183 |
| 17 | 5.0 | .2725 |

Figure 18:
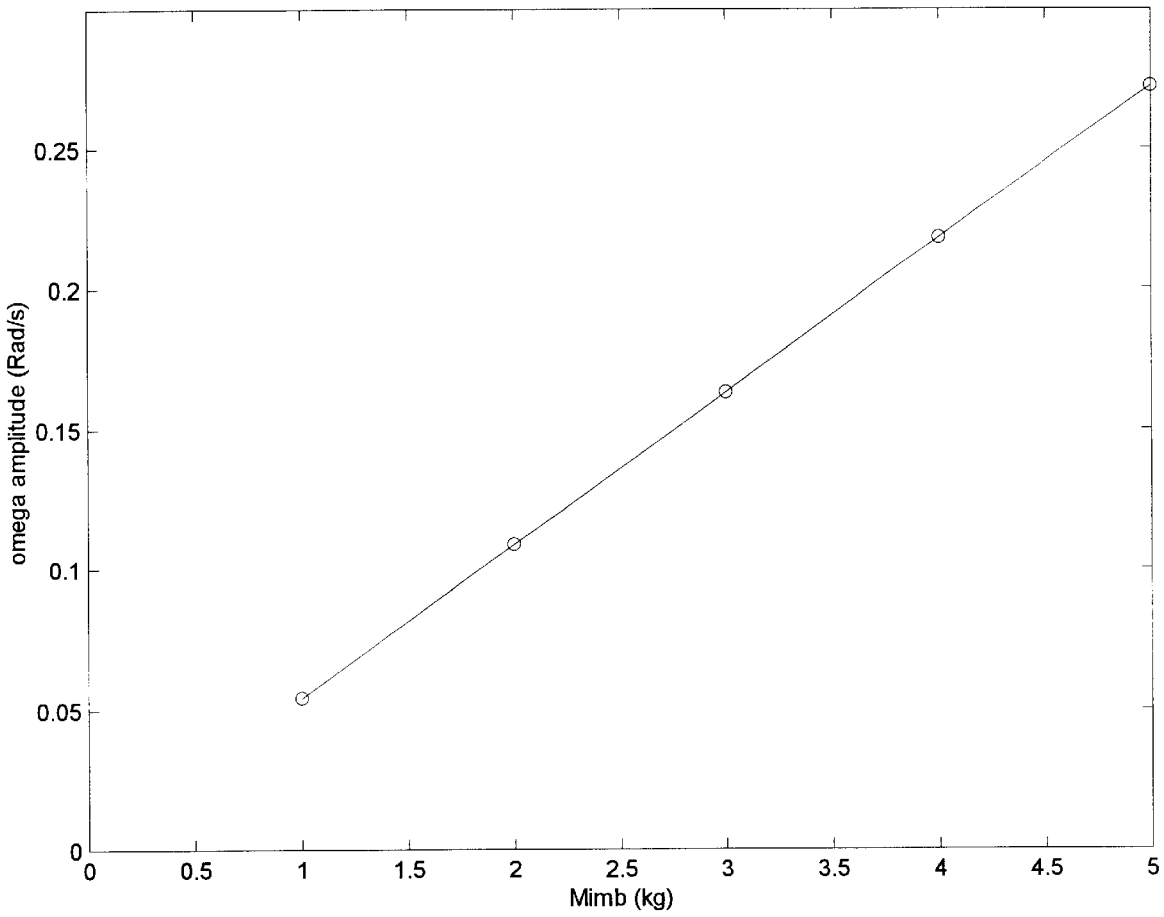
FIG. 18 is a plot of the amplitude of variation in angular velocity vs. load imbalance.

FIG. 18 shows a plot of $(\omega)_{amplitude}$ vs. the magnitude of unbalanced mass 30 ($M_i$). The reader will observe that the relationship does indeed appear to be linear. This may be expressed by the equation:

$$M_i=(\omega)_{amplitude}/k3 \quad \text{(Equation 16)}$$

where k3 is a constant equal to the slope of the line shown in FIG. 18. Although the curve shown in FIG. 18 appears to be perfectly linear, the reader should be aware that it is not. There are actually slight off-linear variations in the curve, caused by frictional and inertial coupling effects. However, as is made plain by the figure, the curve may be assumed to be linear without introducing appreciable error. Thus, if a value for $(\omega)_{amplitude}$ is known, a value for the magnitude of unbalanced mass 30 may be easily determined.

However, as was explained above, a value for the angular velocity of drum 12 is not generally known without an additional sensor. A more preferable solution is to develop an equation that calculates the magnitude of unbalanced mass 30 on the basis of the amplitude of variation in the power phase angle, which is known from the use of the PWM Inverter Drive disclosed in Unsworth et.al. The needed equation was previously presented as:

$$(\omega)_{amplitude}=k2*(\Phi)_{amplitude} \quad \text{(Equation 15)}$$

This equation may easily be rewritten as:

$$(\Phi)_{amplitude}=k2/(\omega)_{amplitude} \quad \text{(Equation 16)}$$

Figure 19:
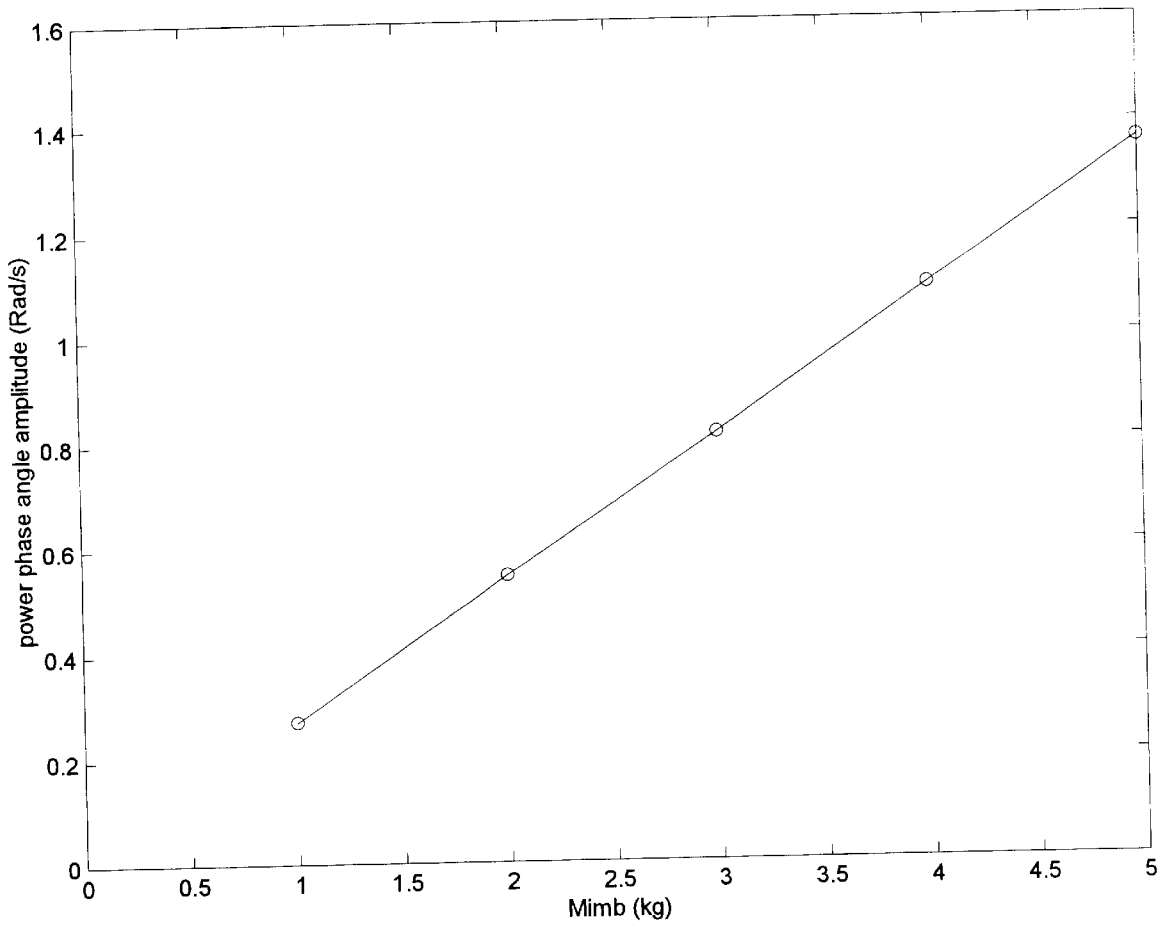
FIG. 19 is a plot of the amplitude of variation in power phase angle vs. load imbalance.

From this equation, it is apparent that if $(\omega)_{amplitude}$ is linearly proportional to the magnitude of unbalanced mass 30 (which it is—FIG. 18), then $(\Phi)_{amplitude}$ should be linearly proportional as well. FIG. 19 demonstrates that this is indeed the case. In FIG. 19, the reader will observe that the plot of $(\Phi)_{amplitude}$ vs. the magnitude of unbalanced mass 30 is almost perfectly linear. A solution for the magnitude of unbalanced mass 30 may then be written as:

$$M_i=(\Phi)_{amplitude}/k4 \quad \text{(Equation 17)}$$

where k4 is the slope of the line shown in FIG. 19. Thus, by obtaining a value for the amplitude of variation in the power phase angle, one can calculate the magnitude of unbalanced mass 30. This figure may then be fed into Equation 2, presented again below, to solve for optimum angular velocity during the water extraction cycle:

$$\omega=\sqrt{F_{v/(M_i*r_i)}} \quad \text{(Equation 2)}$$

Thus, the power phase angle approach can solve for the optimum angular velocity without using any additional sensors. Instead, it makes use of the measurement capabilities contained with the PWM Inverter Drive. It is therefore the preferred embodiment.

The reader should be aware that the previous development of the mathematical equations explaining the dynamic behavior of washing machine 10 is not really necessary to the application of the technique disclosed. Turning again to FIG. 19, it is apparent that if one measures the variation in $(\Phi)_{amplitude}$ while placing different unbalanced masses 30 in drum 12, one may empirically develop a plot similar to FIG. 19, and thereby obtain a value for the constant k4. It is therefore easy to design a controlled experiment in which a table of values for $(\Phi)_{amplitude}$ is constructed in relation to different values for unbalanced mass 30. There are then two options for using the data to control washing machine 10: (1) use the data to solve for the constant k4, and then use Equation 17 and Equation 2 to solve for ω; or (2) store the data as a memory look-up table, so that once the value for $(\Phi)_{amplitude}$ is determined, a memory retrieval function retrieves the corresponding value for $M_i$, and Equation 2 is then used to solve for ω. Thus, for a washing machine having a construction similar to washing machine 10, it will always be possible to calculate the optimum terminal angular velocity during the water extraction cycle. It is not necessary to develop a mathematical model of the system dynamics.

At several points in the previous disclosure, the statement was made that the magnitude determined for unbalanced mass 30, though fairly accurate, is not exact. It does include some error. This error primarily results from the fact that it is impractical to determine the total clothing load within drum 12 without using additional sensors. Variations in total clothing load will obviously affect the magnitude of the variations induced in angular acceleration, angular velocity, and power phase angle, for a given magnitude of unbalanced mass 30. This fact is made plain by reviewing Equation 8, presented again below:

$$\alpha=1/I_t*(T_d-kf*\omega-M_i*g*r*\cos(\theta)) \quad \text{(Equation 8)}$$

Figure 12:
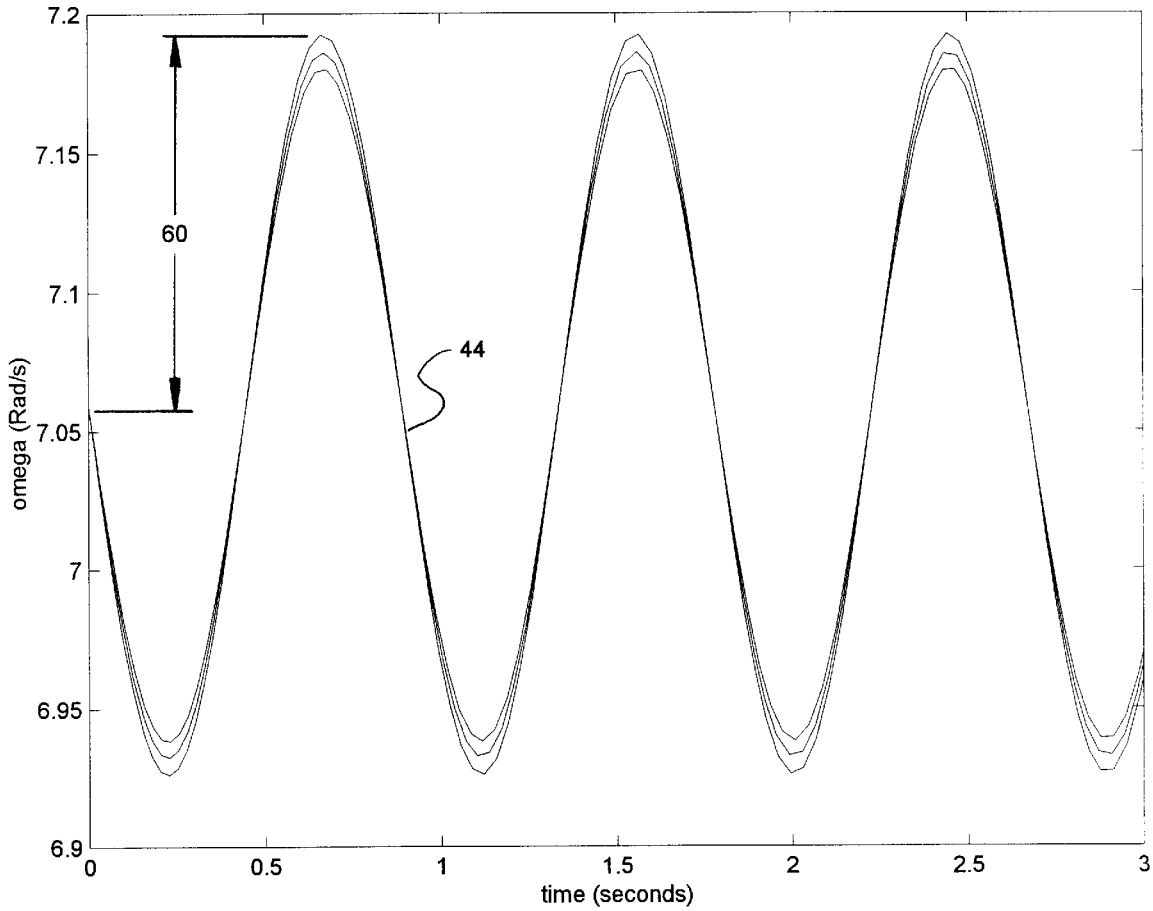
FIG. 12 is a plot of angular velocity vs. time, illustrating the variation in amplitude caused by a variation in total clothing load.
Figure 13:
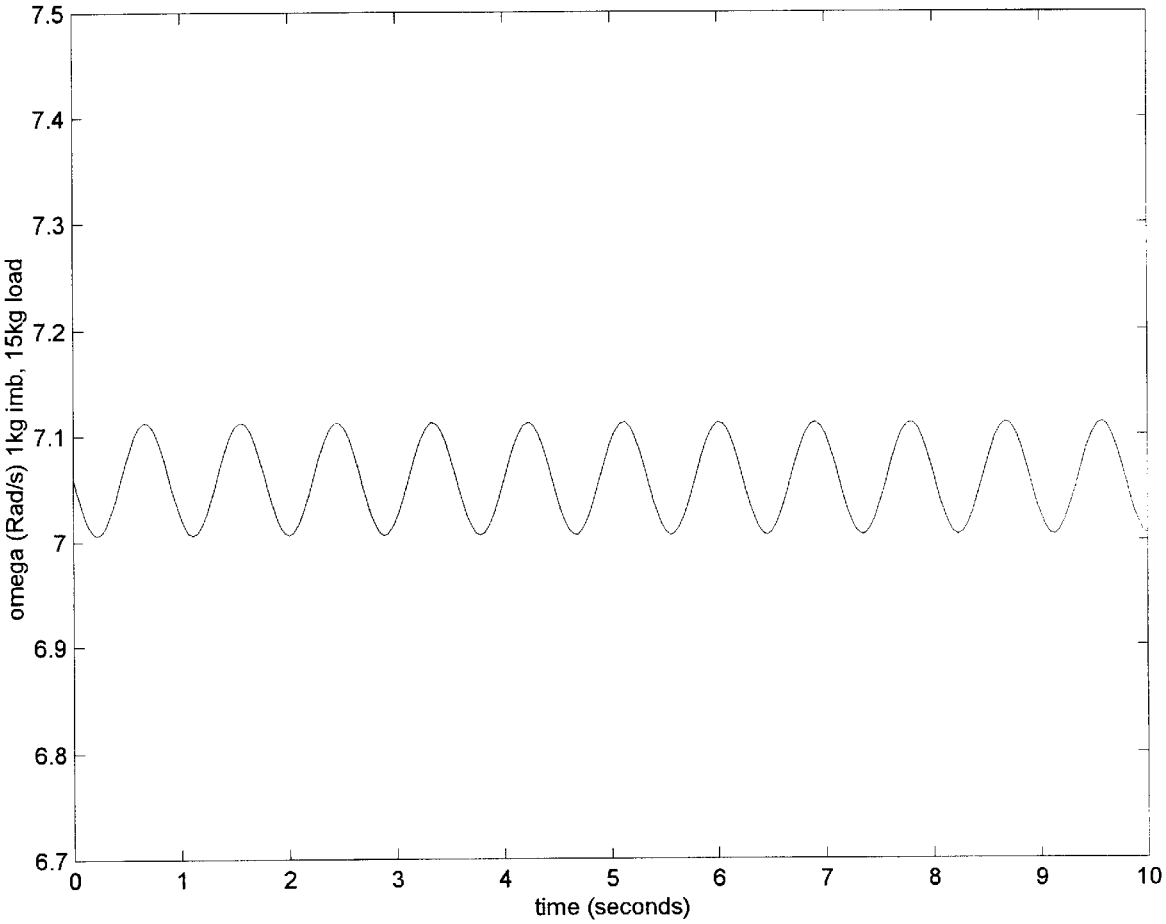
FIG. 13 is a plot of angular velocity vs. time for a load imbalance of 1 kg.
Figure 14:
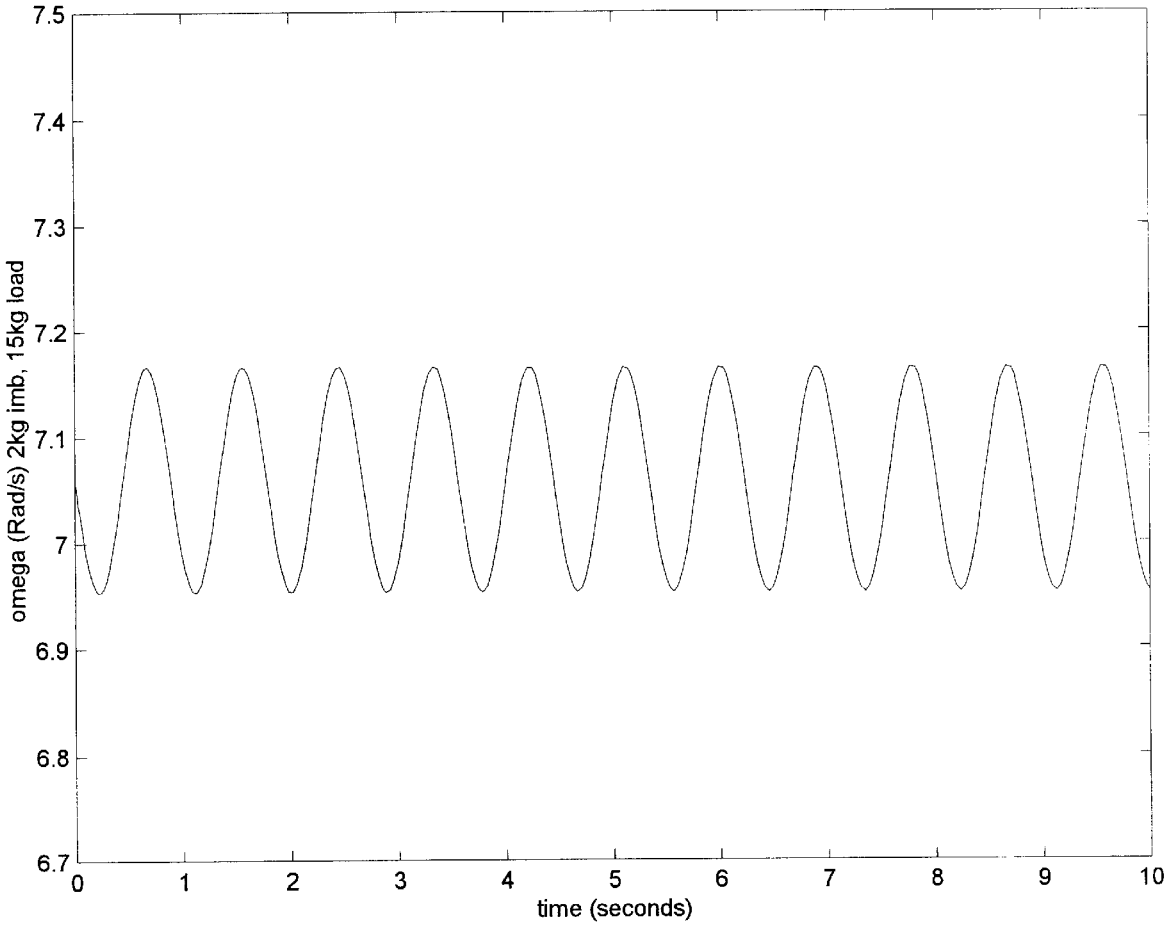
FIG. 14 is a plot of angular velocity vs. time for a load imbalance of 2 kg.
Figure 15:
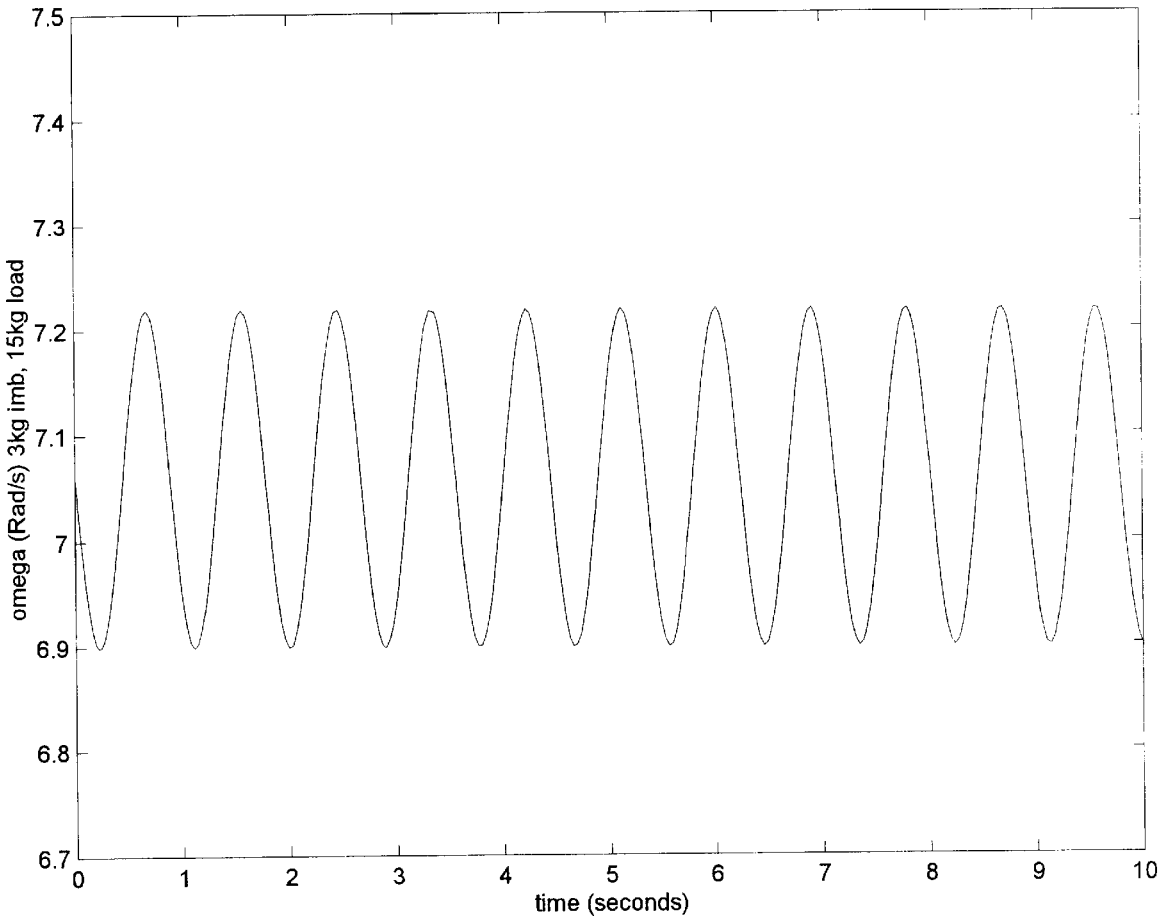
FIG. 15 is a plot of angular velocity vs. time for a load imbalance of 3 kg.
Figure 16:
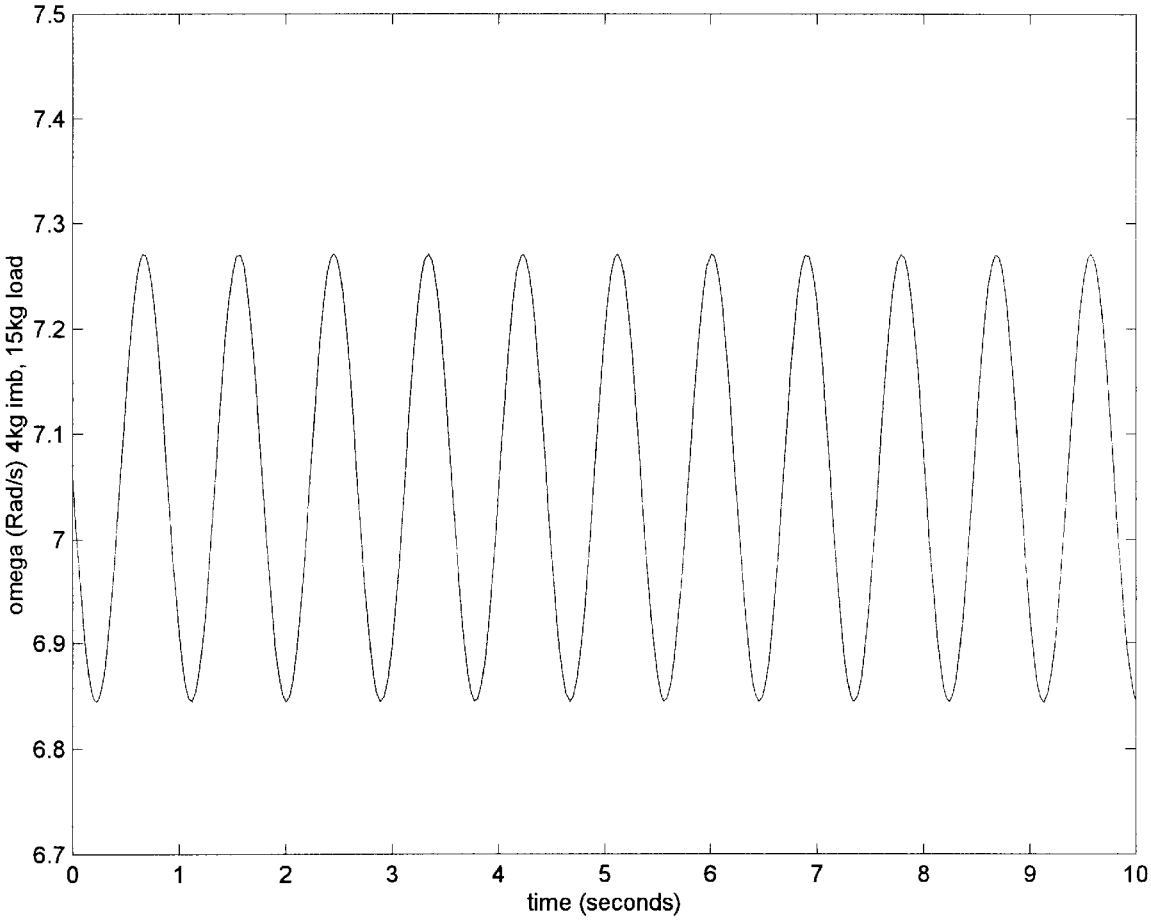
FIG. 16 is a plot of angular velocity vs. time for a load imbalance of 4 kg.
Figure 17:
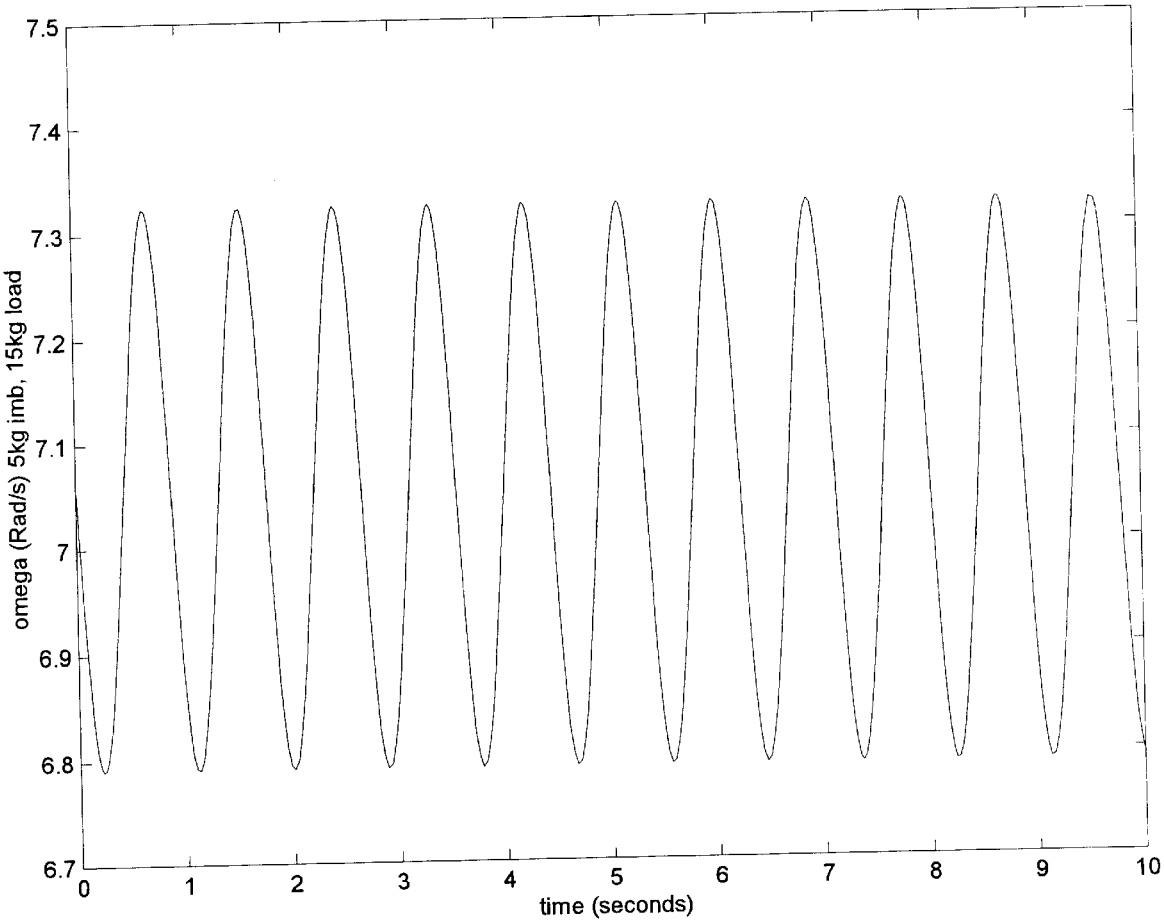
FIG. 17 is a plot of angular velocity vs. time for a load imbalance of 5 kg.

$I_t$ represents the total moment of inertia for the rotating system. Increasing the total clothing load will obviously increase $I_t$, with a consequent decrease in angular acceleration ($\alpha$). All the values discussed previously, except torque, are functions of angular acceleration. Thus, a variation in the total clothing load results in a shift in the curves for angular acceleration, angular velocity, and power phase angle. FIG. 12 shows a plot of angular acceleration vs. time for a load imbalance of 3 kg. The three different curves shown for unbalanced angular velocity 44 represent the different results for total clothing loads of 15 kg, 19 kg, and 23 kg. As may be readily observed, the variation in angular velocity amplitude 60 is relatively small.

Figure 20:
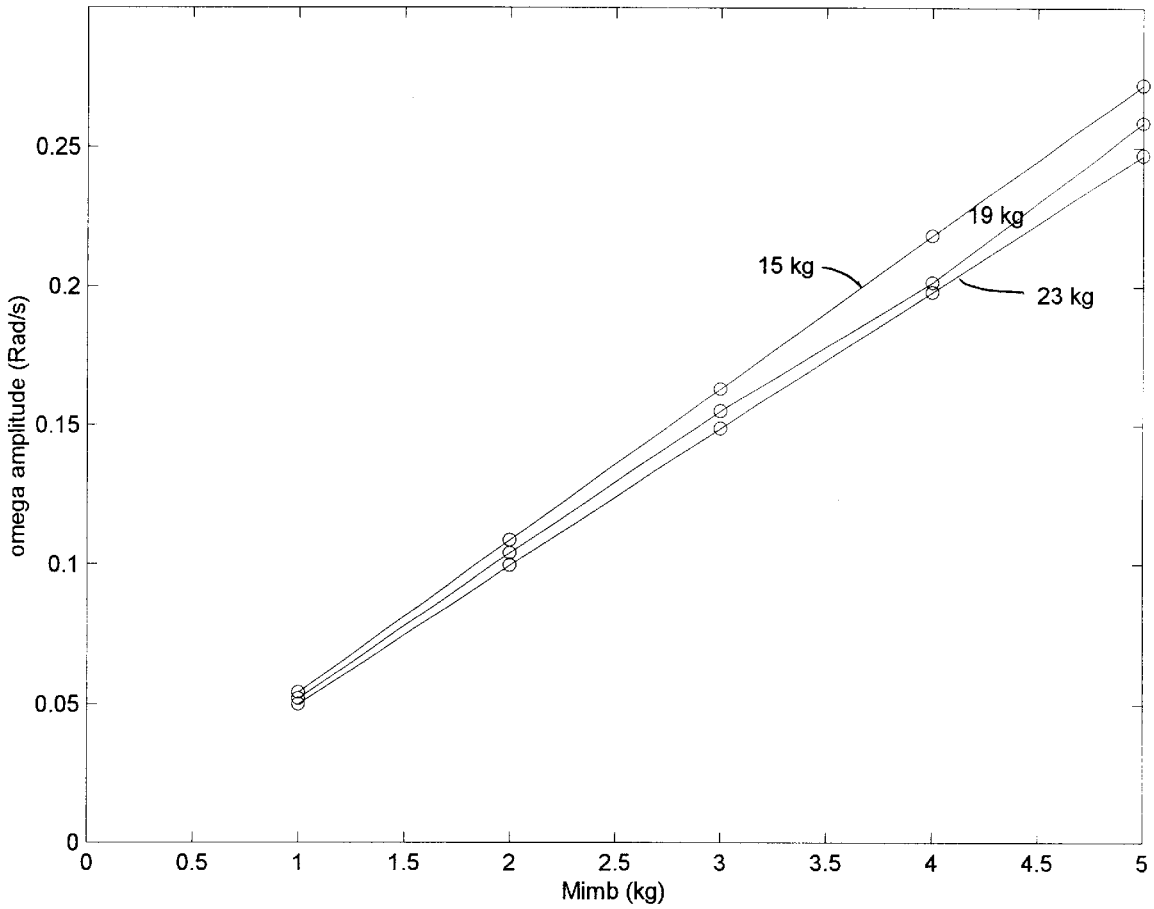
FIG. 20 is a plot of the amplitude of variation in angular velocity vs. load imbalance, for three different total clothing loads.

The moment of inertia for the rotating mass within washing machine 10 is 8.3 kg*m$^2$. This figure represents the moment of inertia when drum 12 is completely empty. The additional moment of inertia for a saturated clothing load varies in the range between 1.95 kg*m$^2$ and 3.00 kg*m$^2$. These figures correspond to a saturated clothing mass in the range of 15 kg to 23 kg. Thus, the moment of inertia introduced by the saturated clothing load is relatively small in comparison to the moment of inertia already present when drum 12 is empty. From this fact, one would expect that the error introduced by variation in total clothing load would be relatively small. Turning to FIG. 20, the reader will see that this is indeed the case.

Figure 21:
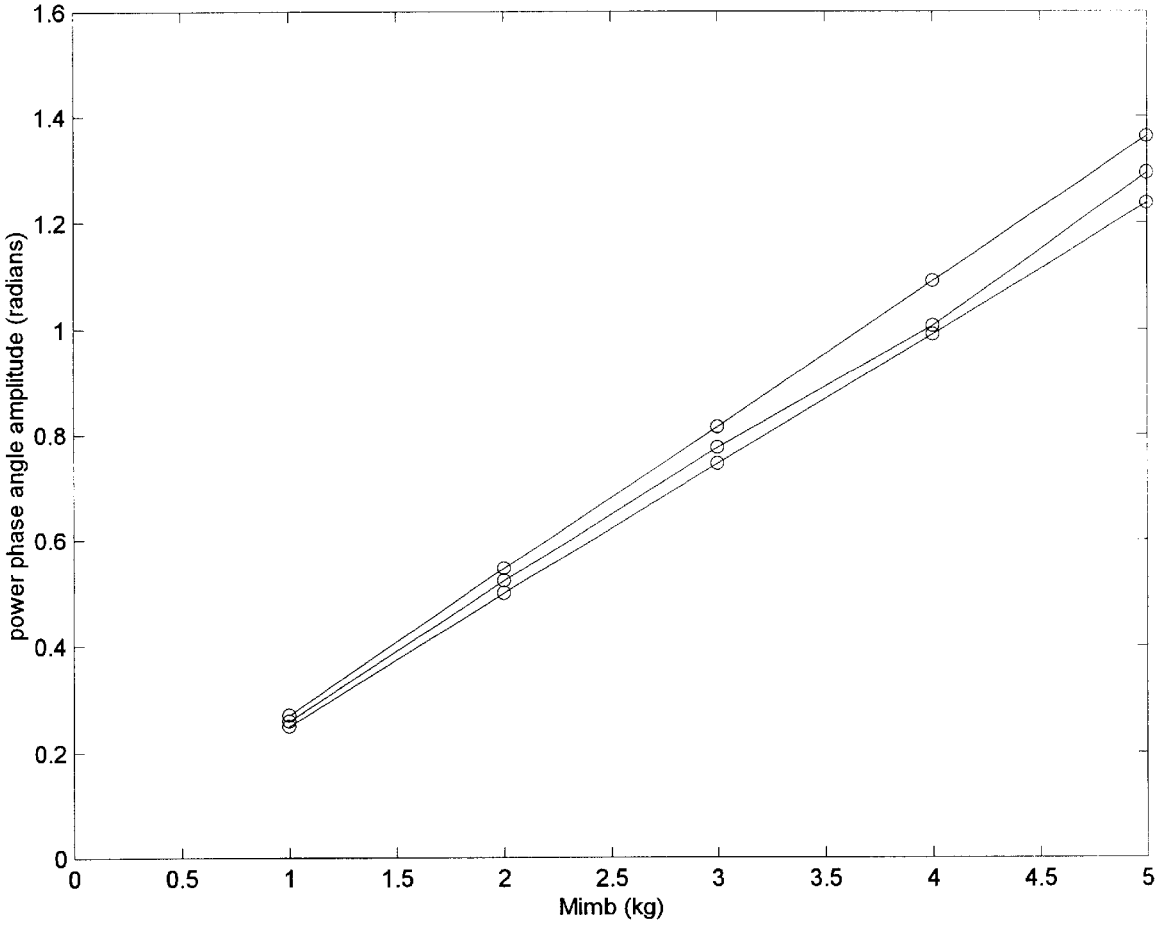
FIG. 21 is a plot of the amplitude of variation in power phase angle vs. load imbalance, for three different total clothing loads.

The upper curve shown in FIG. 20 represents $(\omega)_{amplitude}$ vs. unbalanced mass 30 for a 15 kg total clothing load. The middle curve corresponds to a 19 kg total clothing load, and the bottom curve corresponds to a 23 kg total clothing load. FIG. 21 shows the same study in terms of $(\Phi)_{amplitude}$. Using the middle, or 19 kg, curve, will allow a fairly accurate computation of the magnitude of unbalanced mass 30 over a wide range of total clothing loads. Thus, the power phase angle method disclosed may be used without knowing the total clothing load, and without introducing a significant error in the calculation of unbalanced mass 30.

SUMMARY, RAMIFICATIONS, AND SCOPE

Accordingly, the reader will appreciate that the proposed invention allows the determination of the magnitude of unbalanced mass 30, which value is then used to calculate the optimum angular velocity for drum 12 during the water extraction cycle. Furthermore, the proposed invention has additional advantages in that:

1. In the case of the power phase angle method, it can determine the imbalance in the spinning load without the need for additional sensors;
2. It provide adjustment of the terminal spin speed over a continuous range, rather than choosing from a few discrete spin velocities;
3. In the event of a significant load imbalance, it provides a reduced terminal spin speed, rather than a machine shutdown; and
4. It can determine the load imbalance with sufficient accuracy to calculate the appropriate terminal spin speed, without having a value for the total clothing load.

Although the preceding description contains significant detail, it should not be construed as limiting the scope of the invention but rather as providing illustrations of the preferred embodiments of the invention. Thus, the scope of the invention should be fixed by the following claims, rather than by the examples given.

Having described our invention, we claim:

1. A laundry washing machine, comprising:

a. a rotatable drum for receiving the laundry to be washed, with said rotatable drum having a non-vertical axis of rotation;

b. an electrically energized drive motor, with means connecting said drive motor to said drum so that said drum rotates with said drive motor;

c. electrical control means connected to said drive motor and effective to measure the amplitude of variation in the power phase angle of said drive motor; to compute the magnitude of the unbalanced mass within said drum based on said amplitude of variation in the power phase angle; to compute an optimum angular velocity for said drum during the water extraction cycle based on said computed magnitude of said unbalanced mass; and to energize said drive motor so as to accelerate said drum to said optimum angular velocity.

2. A laundry washing machine as recited in claim 1, wherein said electrical control means comprises a Pulse Width Modulated Inverter Drive.

3. The laundry washing machine of claim 1 wherein the magnitude of the unbalanced mass within said drum is computed by dividing the amplitude of variation in the power phase angle by a constant slope of a line derived by graphically plotting values of amplitude of variation in the power phase angle on a vertical axis versus corresponding values of magnitude of unbalanced mass on a horizontal axis.

4. The laundry washing machine of claim 1 wherein the optimum angular velocity is computed by obtaining the square root of the magnitude of vibration force of the washing machine divided by the product of the magnitude of unbalanced mass and the radius of said drum.

5. A laundry washing machine, comprising:

a. a rotatable drum for receiving the laundry to be washed, with said rotatable drum having a non-vertical axis of rotation;

b. an electrically energized drive motor, with means connecting said drive motor to said drum so that said drum rotates with said drive motor;

c. electrical control means connected to said drive motor and effective to measure the amplitude of variation in the motor terminal current of said drive motor; to compute the magnitude of the unbalanced mass within said drum based on said amplitude of variation in the motor terminal current; to compute an optimum angular velocity for said drum during the water extraction cycle based on said computed magnitude of said unbalanced mass; and to energize said drive motor so as to accelerate said drum to said optimum angular velocity.

6. A laundry washing machine as recited in claim 5, wherein said electrical control means comprises a Pulse Width Modulated Inverter Drive.

7. A laundry washing machine, comprising:

a. a rotatable drum for receiving the laundry to be washed, with said rotatable drum having a non-vertical axis of rotation;

b. an electrically energized drive motor, with means connecting said drive motor to said drum so that said drum rotates with said drive motor;

c. memory means capable of storing a set of empirically determined values for the magnitude of unbalanced mass within said drum corresponding to values for the amplitude of variation in the power phase angle of said drive motor;

d. electrical control means connected to said drive motor and effective to measure the amplitude of variation in the power phase angle of said drive motor; to access said memory means to retrieve the corresponding value for said magnitude of said unbalanced mass within said drum based on said value for said amplitude of variation in the power phase angle; to compute an optimum angular velocity for said drum during the water extraction cycle based on said computed magnitude of said unbalanced mass; and to energize said drive motor so as to accelerate said drum to said optimum angular velocity.

8. A laundry washing machine as recited in claim 7, wherein said electrical control means comprises a Pulse Width Modulated Inverter Drive.

9. A method for determining an optimum angular velocity for a rotatable drum in a laundry washing machine containing an unbalanced mass of laundry comprising the steps of:

(a) providing an electrically energized drive motor connected to said drum so that said drum rotates with said drive motor, and electrical control means connected to said drive motor for measuring the amplitude of variation in the power phase angle of said drive motor;

(b) measuring the amplitude of variation in the power phase angle of said drive motor;

(c) computing the magnitude of the unbalanced mass of laundry contained within said drum by dividing the amplitude of variation in the power phase angle by a constant slope of a line derived by graphically plotting values of amplitude of variation in the power phase angle on a vertical axis versus corresponding values of magnitude of unbalanced mass on a horizontal axis;

(d) computing the optimum angular velocity by obtaining the square root of the magnitude of vibration force of the washing machine divided by the product of the magnitude of unbalanced mass and the radius of said drum.

* * * * *